US006397627B1

(12) United States Patent
Aki et al.

(10) Patent No.: US 6,397,627 B1
(45) Date of Patent: Jun. 4, 2002

(54) RECEIVER-INTEGRATED CONDENSER

(75) Inventors: Yoshifumi Aki, Kariya; Etuo Hasegawa, Nagoya; Hiroki Matsuo; Tetsuji Nobuta, both of Kariya; Michiyasu Yamamoto, Chiryu; Mitsukawa Kazuhiro, Bisai; Eiji Okabayashi, Okazaki, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/518,396

(22) Filed: Mar. 3, 2000

(30) Foreign Application Priority Data

Mar. 5, 1999 (JP) ..... 11-059254
Jul. 8, 1999 (JP) ..... 11-194793
Nov. 15, 1999 (JP) ..... 11-324570

(51) Int. Cl.[7] ..... F25B 39/04
(52) U.S. Cl. ..... 62/509
(58) Field of Search ..... 62/509, 498, 467; 165/71, 72, 73, 74, 132

(56) References Cited

U.S. PATENT DOCUMENTS 5,394,710 A * 3/1995 Matsuo et al. ..... 62/509
5,546,761 A 8/1996 Matsuo et al.
5,592,830 A * 1/1997 Baba et al. ..... 62/509
5,709,106 A * 1/1998 Inaba et al. ..... 62/507
5,711,167 A * 1/1998 Ha et al. ..... 62/652
5,713,217 A * 2/1998 Baba ..... 62/509
5,875,650 A 3/1999 Nobuta et al.
5,913,362 A * 6/1999 Jun ..... 165/132
5,934,102 A * 8/1999 DeKeuster et al. ..... 62/509
6,182,744 B1 * 2/2001 Nakamura et al. ..... 165/140
6,250,103 B1 * 6/2001 Watanabe et al. ..... 62/509

FOREIGN PATENT DOCUMENTS

JP A-5-141812 6/1993

* cited by examiner

*Primary Examiner*—Teresa Walberg
*Assistant Examiner*—Daniel Robinson
(74) *Attorney, Agent, or Firm*—Harness, Dickey & Pierce, PLC

(57) ABSTRACT

In a receiver-integrated condenser, a super-cooling portion for cooling liquid refrigerant from a receiving unit is disposed between first and second condensing portions in a core portion in a vertical direction. Therefore, in an engine-idling, even when high-temperature air having passed through the receiver-integrated condenser is introduced again toward an upstream air side of the receiver-integrated condenser through a lower side of the receiver-integrated condenser, the high-temperature air is not introduced toward the arrangement position of said super-cooling portion, because the super-cooling portion is positioned at an upper side from the second condensing portion. Thus, super-cooling performance of refrigerant in the super-cooling portion of the core portion is prevented from being decreased even in the engine idling.

16 Claims, 23 Drawing Sheets

RECEIVER-INTEGRATED CONDENSER

CROSS-REFERENCE TO RELATED APPLICATION

This application is related to and claims priority from Japanese Patent Applications No. Hei. 11-59254 filed on Mar. 5, 1999, No. Hei. 11-194793 filed on Jul. 8, 1999 and No. Hei. 11-324570 filed on Nov. 15, 1999, the contents of which are hereby incorporated by reference.

BACKGROUND OF THE INVENTION

1. Field of the Invention

The present invention relates to a receiver-integrated condenser in which a condensing portion for cooling and condensing refrigerant, a receiving unit for separating gas refrigerant and liquid refrigerant from the condensing portion, and a super-cooling portion for super-cooling liquid refrigerant from the receiving unit are integrally formed. The receiver-integrated condenser is suitably used for a vehicle air conditioner.

2. Description of Related Art

JP-A-5-141812 describes a receiver-integrated condenser in which a condensing unit for condensing refrigerant and a receiving unit for separating refrigerant from the condensing unit into gas refrigerant and liquid refrigerant are integrally formed. In the conventional receiver-integrated condenser, two supplementary passages extending in a tank longitudinal direction are provided between a header tank of the condensing unit and the receiving unit. Therefore, the header tank of the condensing unit and the receiving unit communicate with each other through the supplementary passages, and the supplementary passages are used as a heat-insulating space between the header tank and the receiving unit. However, because a super-cooling portion for super-cooling liquid refrigerant separated in the receiver is not provided, a super-cooling degree of high-pressure side liquid refrigerant in a refrigerant cycle is not improved.

On the other hand, in a receiver-integrated condenser described in U.S. Pat. No. 5,546,761, a super-cooling portion for super-cooling liquid refrigerant separated in a receiving unit is disposed at a lower position of a core portion of a condensing unit. That is, for stably introducing liquid refrigerant into the super-cooling portion from the receiving unit, liquid refrigerant is introduced from a bottom side of the receiving unit, and the super-cooling portion is set at a lowest position of the core portion. However, during an engine idling such as in a case where a vehicle waits for the traffic lights to change, because an air flow due to a travelling dynamical force is not generated, a high-temperature air having passed through the receiver-integrated condenser and a radiator may be introduced into again an upstream air side of the receiver-integrated condenser through a lower side portion of the receiver-integrated condenser by the operation of a cooling fan. Thus, the lower side of the condensing unit is restricted from cooling, and the super-cooling performance of liquid refrigerant in the super-cooling portion is greatly reduced.

SUMMARY OF THE INVENTION

In view of the foregoing problems, it is an object of the present invention to provide a receiver-integrated condenser having a super-cooling member, which prevents cooling performance of liquid refrigerant in the super-cooling member from being decreased due to high-temperature air passing therethrough.

It is an another object of the present invention to provide a receiver-integrated condenser in which a refrigerant passage structure is made simple and an arrangement position of a super-cooling member is readily set.

It is a further another object of the present invention to provide a receiver-integrated condenser for a refrigerant cycle, in which a refrigerant sealing amount of the refrigerant cycle is readily checked.

It is a further another object of the present invention to provide a hole forming method for a receiver-integrated condenser.

According to the present invention, a receiver-integrated condenser for a refrigerant cycle includes a condensing member for cooling and condensing super-heating gas refrigerant from a compressor of the refrigerant cycle, a receiving unit for separating refrigerant from the condensing member into gas refrigerant and liquid refrigerant and for storing liquid refrigerant therein, and a super-cooling member for super-cooling liquid refrigerant from the receiving unit. The receiving unit is integrated with the condensing member, and the super-cooling member is integrated with the condensing member. Further, the condensing member includes a first condensing portion at an upper side from the super-cooling member, and a second condensing portion at a lower side from the super-cooling portion. In the receiver-integrated condenser, the super-cooling member is disposed between the first and second condensing portions in a vertical direction. Thus, in an engine idling such as in a case where a vehicle waits for the traffic lights to change, high-temperature air having passed through the receiver-integrated condenser and a radiator is not introduced again toward the arrangement position of the super-cooling member. As a result, even in the engine-idling, the cooling performance of the super-cooling member is improved. Further, because the super-cooling member is disposed between the first and second condensing portions in the vertical direction, the super-cooling member is positioned around a high-air distribution area of a cooling fan, and cooling effect of refrigerant in the super-cooling member is further improved.

Preferably, the receiver-integrated condenser includes a core portion having a plurality of tubes through which refrigerant flows in a horizontal direction, a first header tank extending in a vertical direction perpendicular to the horizontal direction and being connected to each one side end of the tubes to communicate with the tubes, a second header tank extending in the vertical direction and being connected to each the other side end of the tubes to communicate with the tubes, and a wall member for defining first and second communication passages. In the receiver-integrated condenser, the core portion is disposed to define the condensing member and the super-cooling member for super-cooling liquid refrigerant, and the receiving unit is integrated with the second header tank. Refrigerant from the condensing member is introduced toward the receiving unit through the first communication passage, liquid refrigerant separated in the receiving unit is introduced toward the super-cooling member through the second communication passage, and the first and second communication passages are arranged in parallel to extend in the vertical direction along the second header tank and the receiving unit between the second header tank and the receiving unit.

In the receiver-integrated condenser, at least two parts of the second header tank, the receiving unit and the wall member for defining the first and second communication passages are an integrally molded member. Therefore, a refrigerant passage structure of the receiver-integrated condenser is made simple using the first and second communication passages, and the arrangement position of the super-cooling member is readily changed in the vertical direction.

Preferably, the receiver-integrated condenser further includes a cover member for closing at least an upper side opening of the second communication passage, and a sight glass for checking a gas-liquid state of refrigerant in the second refrigerant passage. The sight glass is disposed in the cover member. Because liquid refrigerant from the receiving unit flows through the second communication passage, a gas-liquid state of refrigerant at an outlet of the receiving unit is readily determined through the sight glass. Therefore, refrigerant sealing operation is accurately performed in accordance with the gas-liquid state of refrigerant at the outlet of the receiving unit. Further, because the sight glass is provided in the cover member at the upper end opening of the second communication passage, the gas-liquid state of refrigerant is readily checked from the sight glass without any additional operation.

According to an another aspect of the present invention, a first communication pipe is disposed outside a second header tank and a receiving unit so that liquid refrigerant within a receiving unit flows toward a super-cooling member through the first communication pipe. Therefore, using the first communication pipe, the arrangement position of the super-cooling member is readily changed. Further, a connection structure between the second header tank and the receiving unit is made simple because the first communication pipe is disposed outside the second header tank and the receiving unit.

Further, the second header tank and the receiving unit are disposed to have a communication hole therebetween through which refrigerant having passed through the second header tank from the condensing member flows toward the receiving unit. Further, a second communication pipe is disposed outside the second header tank and the receiving unit in such a manner that refrigerant passing through the condensing member flows through a refrigerant passage defined by the second communication pipe. Therefore, the refrigerant passage structure is further made simple.

According to a further another aspect of the present invention, a hole forming method for forming a communication hole in a partition member for partitioning an interior portion of a pipe-like outer wall of a heat exchanger into plural spaces includes: inserting a punch member in a space between the partition member and the outer wall at a predetermined position; attaching and contacting a pressing jig onto the punch member through a hole portion provided in the outer wall; and adding a press force to the punch member by the pressing jig so that the partition member is punched by the punch member to form the communication hole. Thus, pressing force is vertically applied from a directly upper side of the punch member to the punch member by using the pressing jig attached through the hole portion of the outer wall. As a result, punch load is accurately applied to the partition member, and the communication hole is accurately punched. Accordingly, when the hole forming method is applied to a receiver-integrated condenser, a communication hole is readily formed in a partition member.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention will be described hereinafter with reference to the accompanying drawings.

Figure 1:
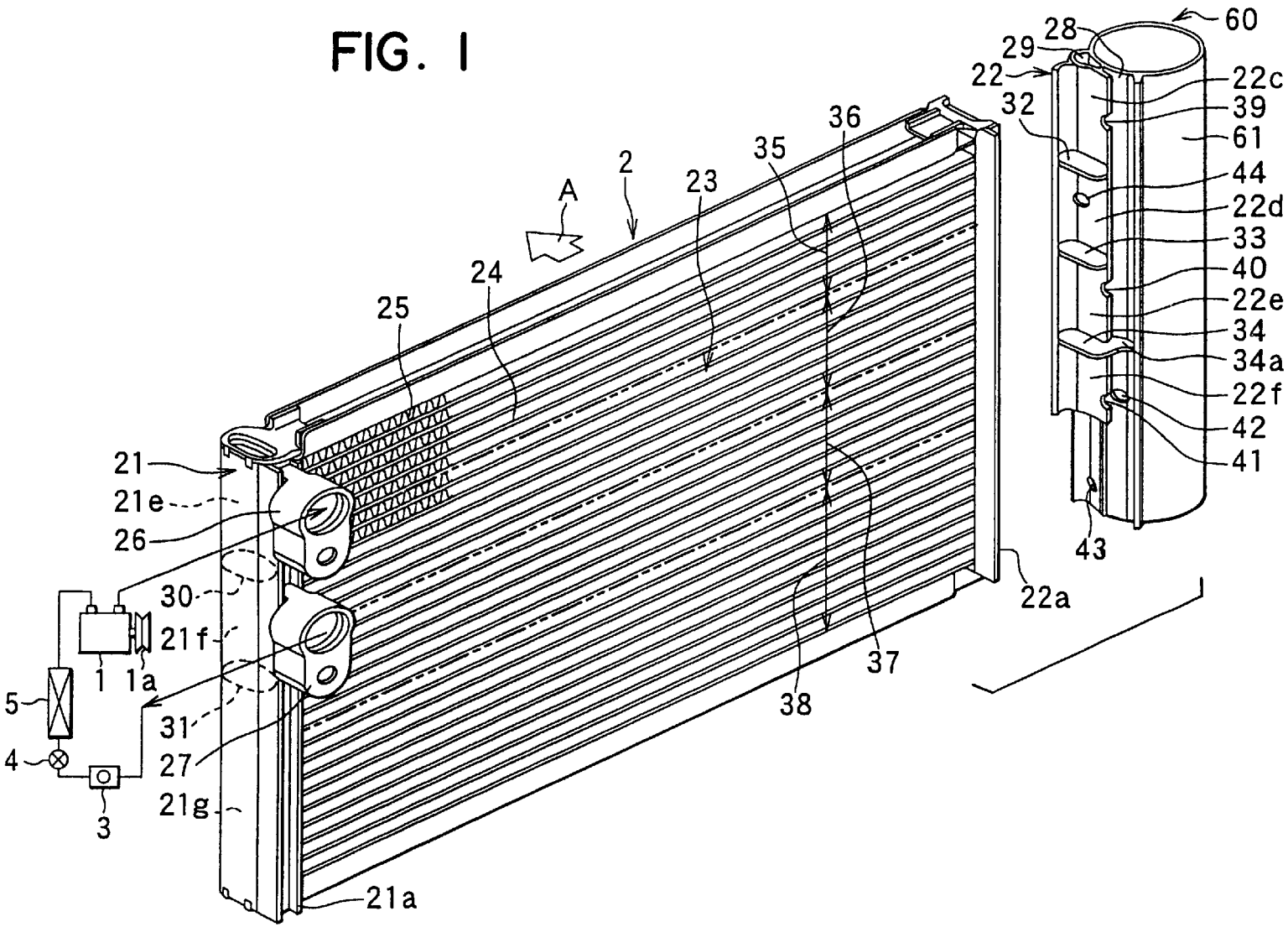
FIG. 1 is an exploded view showing a receiver-integrated condenser according to a first preferred embodiment of the present invention.

A first preferred embodiment of the present invention will be now described with reference to FIGS. 1–7. In the first embodiment, the present invention is typically applied to a receiver-integrated condenser of a refrigerant cycle of a vehicle air conditioner. As shown in FIG. 1, The refrigerant cycle of the vehicle air conditioner includes a refrigerant compressor 1, a receiver-integrated condenser 2, a sight glass 3, a thermal expansion valve 4, and a refrigerant evaporator 5. All of components of the refrigerant cycle are serially connected by a metal pipe or a rubber pipe to form a closed refrigerant circuit.

The compressor 1 is connected to a vehicle engine disposed within an engine compartment through a belt and an electromagnetic clutch 1*a*. When the rotation power of the engine is transmitted to the compressor 1 through the electromagnetic clutch 1*a*, the compressor 1 compresses gas refrigerant sucked therein from the evaporator 5 and then discharges high-pressure high-temperature gas refrigerant to the receiver-integrated condenser 2.

The receiver-integrated condenser 2 is for condensing and super-cooling the high-temperature high-pressure super-heating gas refrigerant discharged from the compressor 1. The receiver-integrated condenser 2 is disposed at a most front side in the engine compartment, and is cooled by air blown from a cooling fan in a direction shown by the arrow A in FIG. 1. The cooling fan is a common fan for cooling both a radiator for cooling the engine and the receiver-integrated condenser 2.

Liquid refrigerant super-cooled in the receiver-integrated refrigerant condenser 2 passes through the sight glass 3, and is decompressed in the thermal expansion valve 4 to become low-pressure gas-liquid refrigerant. Thereafter, low-pressure refrigerant is evaporated in the evaporator 5 by absorbing heat from air passing therethrough.

Next, the structure of the receiver-integrated condenser 2 will be now described. In the first embodiment, the receiver-integrated condenser 2 is a multi-flow type in which refrigerant flows through a core portion 23 in multi-flows. The receiver-integrated condenser 2 includes a pair of first and second header tanks 21, 22 each of which extends in an up-down direction (i.e., vertical direction). The core portion 23 is disposed between the first and second header tanks 21, 22.

The core portion 23 includes plural flat tubes 24 through which refrigerant flows horizontally between the first and second header tanks 21, 22, and plural corrugated fins 25 each of which is disposed between adjacent flat tubes 24. In each flat tube 24, plural refrigerant passages are formed. Each one side end of the flat tubes 24 communicates with the first header tank 21, and each the other side end of the flat tubes 24 communicates with the second header tank 22.

An inlet joint block 26 from which refrigerant discharged from the compressor 1 flows is connected to the first header tank 21 on an upstream-air side surface of the first header tank 21, and an outlet joint block 27 is connected to the first header tank 21 at a lower side from the inlet joint block 26. As shown in FIG. 1, in the first embodiment, both the joint blocks 26, 27 are disposed at the upstream air side from the first header tank 21 in the air flow direction A. However, in accordance with a refrigerant pipe arrangement state in the vehicle, both joint blocks 26, 27 may be disposed at a downstream air side from the first header tank 21. Each of the first and second herder tanks 21, 22 is formed into an approximate elliptic cylindrical shape to extend in the up-down direction. A cylindrical receiving unit 31 extending in the up-down direction is formed integrally with the second header tank 22 in the receiver-integrated condenser 2.

Figure 3:
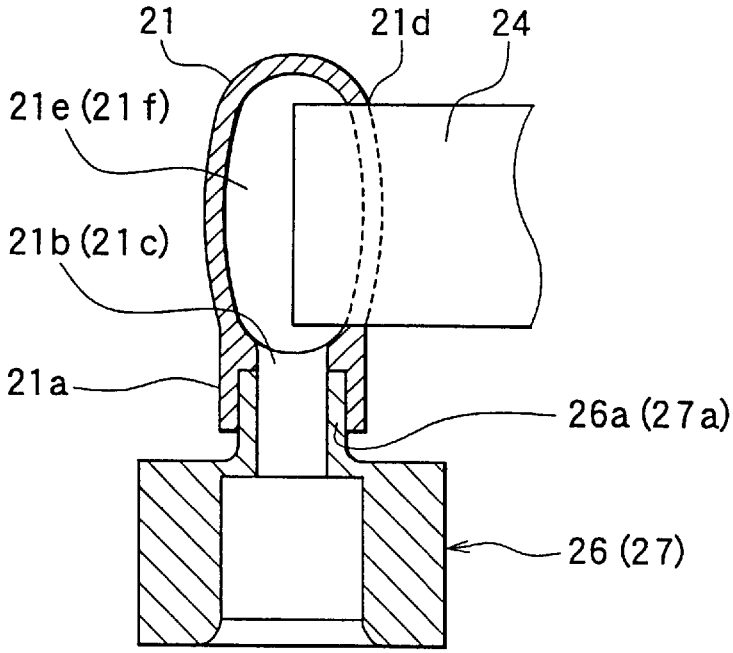
FIG. 3 is a sectional view showing a main portion of the receiver-integrated condenser according to the first embodiment.

The first header tank 21 is integrally molded by aluminum to have a sectional shape shown in FIG. 3. A protrusion portion 21*a* is formed into an approximate U-shape along the longitudinal direction of the first header tank 21 to protrude an outside from one side end of the first header tank 21 in a major-diameter direction of the approximate elliptic sectional shape of the first tank 21. Connection protrusion portions 26*a*, 27*a* of the inlet and outlet joint blocks 26, 27 are inserted into the protrusion portion 21*a* of the first tank 21, respectively. In FIG. 3, at positions where the joint blocks 3 are connected, the bottom portion of the U-shaped protrusion portion 21*a* is opened. However, at the other positions, the first header tank 21 is closed in the bottom portion of the U-shaped protrusion portion 21*a*. Here, each of the joint blocks 26, 27 is made of aluminum, and is brazed to an inner surface of the protrusion portion 21*a* by using a brazing material applied to the surfaces of the joint blocks 26, 27.

At arrangement positions of the joint blocks 26, 27 in the bottom portion of the U-shaped protrusion portion 21*a* of the first header tank 21, communication holes 21*b*, 21*c* are respectively formed after the protrusion of the first header tank 21. Therefore, inner passages of the joint blocks 26, 27 communicate with inner spaces 21*f*, 21*g* of the first header tank 21 through the communication holes 21*b*, 21*c*, respectively.

Tube insertion holes 21*d* are opened in a side surface of the first header tank 21 in the major direction of the approximate-elliptic sectional shape. One side ends of the flat tubes 24 are inserted into the tube insertion holes 21*d*. The first header tank 21 and the flat tubes 24 are brazed to be connected by using a brazing material applied onto the first header tank 21 and the flat tubes 24.

Figure 4:
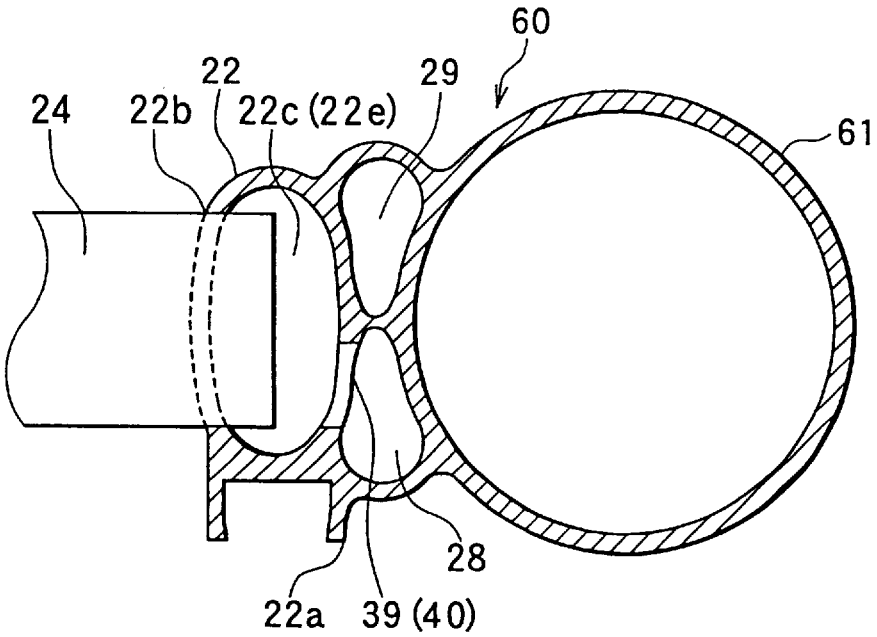
FIG. 4 is a sectional view showing a main portion of the receiver-integrated condenser according to the first embodiment.
Figure 5:
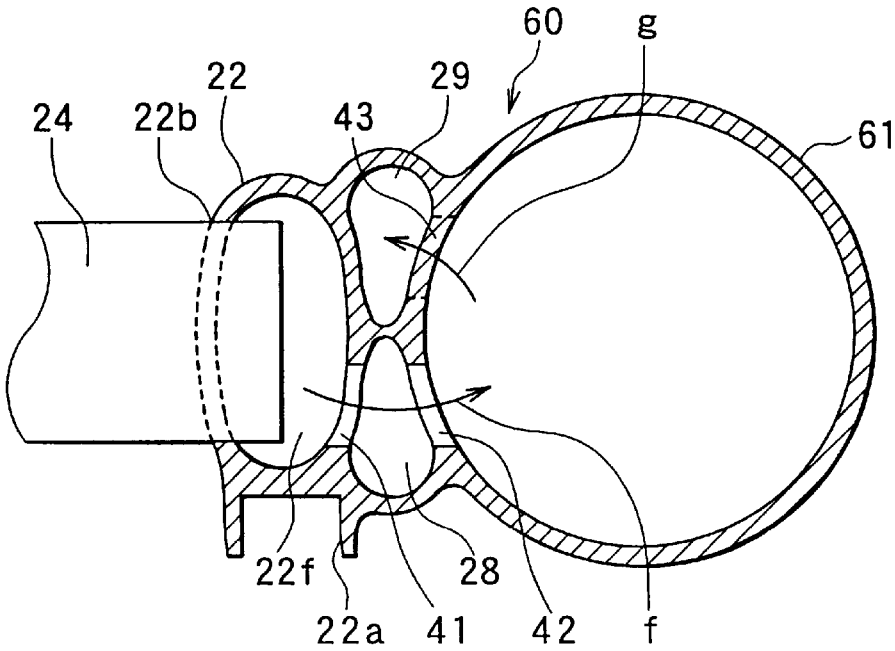
FIG. 5 is a sectional view showing a main portion of the receiver-integrated condenser according to the first embodiment.
Figure 6:
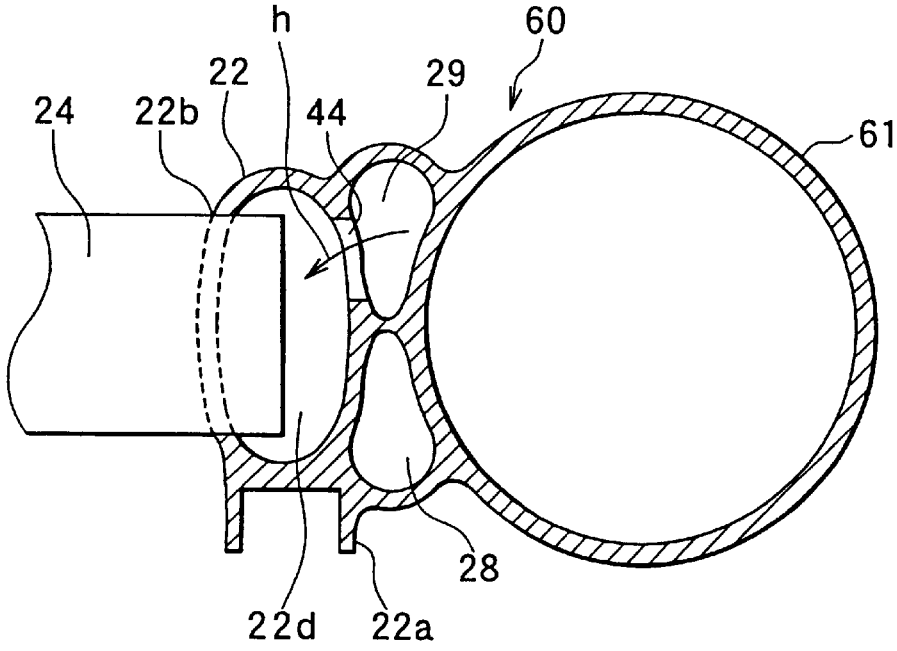
FIG. 6 is a sectional view showing a main portion of the receiver-integrated condenser according to the first embodiment.

On the other hand, the second header tank 22 and the receiving unit 61 are integrally molded by an extrusion of aluminum to form an integrated molding member 60 having a sectional shape shown in FIGS. 4–6. In FIG. 1, for explaining an inner structure of the integrated molding member 60, the integrated molding member 60 is divided in the second header tank 22 in the longitudinal direction of the second header tank 22.

In the first embodiment, the joint blocks 26, 27 are not connected to the second header tank 22. However, similarly to the first header tank 21, a U-shaped protrusion 22*a* is formed in the second header tank 22. Therefore, the U-shaped protrusion 22*a* can be used as an attachment portion of an attachment bracket. Further, one or both of the inlet joint block 26 and the outlet joint block 27 disposed in the first header tank 21 may be disposed in the second header tank 22. In this case, the U-shaped protrusion portions 22*a* is used as an attachment portion of the joint blocks 26, 27.

Similarly to the first header tank 21, tube insertion holes 22*b* are opened in a side surface of the second header tank 22 in the major direction of the approximate-elliptic sectional shape. The other side ends of the flat tubes 24 are inserted into the tube insertion holes 22*b*. The second header tank 22 and the flat tubes 24 are brazed to be connected by using a brazing material applied onto the second header tank 22 and the flat tubes 24.

First and second refrigerant passages 28, 29 are formed by extrusion between the second header tank 22 and the receiving unit 61. The first and second refrigerant passages 28, 29 are arranged at upstream and downstream sides in the air flow direction A, so that each of the first and second refrigerant passages 28, 29 extends in the tank longitudinal direction (i.e., up-down direction) between the second header tank 22 and the receiving unit 61.

Refrigerant having passed through a condensing portion described later flows into the first refrigerant passage 28, and is introduced into the receiving unit 61. On the other hand, liquid refrigerant separated from gas refrigerant in the receiving unit 61 flows toward a super-cooling portion described later through the second refrigerant passage 29.

Next, an entire structure of the refrigerant passage in the receiver-integrated condenser 2 will be now described. In the first embodiment, first and second separators 30, 31 are disposed within the first header tank 21. Therefore, an inner space of the first header tank 21 is partitioned into upper, middle and lower spaces 21*e*, 21*f*, 21*g* in the up-down direction by the first and second separators 30, 31. The first separator 30 is disposed at a position immediately lower from the inlet joint block 26 in the up-down direction, and the second separator 31 is disposed at a position immediately lower from the outlet joint block 27 in the up-down direction. A brazing material is applied to the first and second separators 30, 31. Therefore, the first and second separators 30, 31 are inserted from slit holes (not shown) of the first header tank 21 to be brazed therein.

Figure 2:
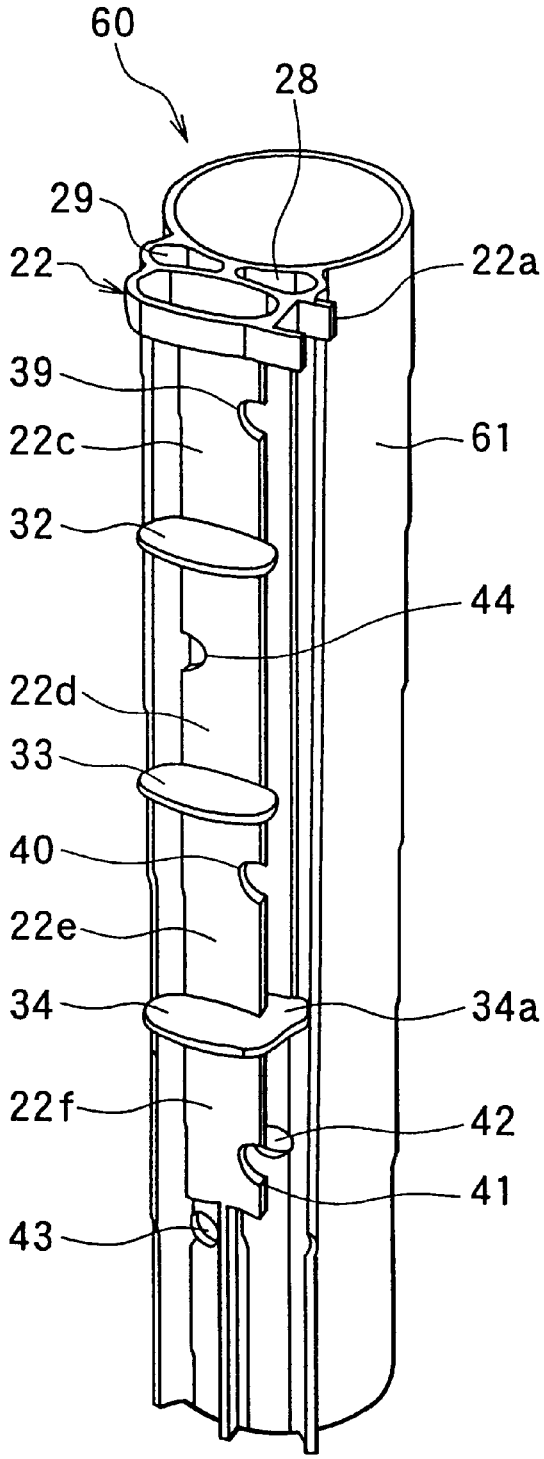
FIG. 2 is an enlarged perspective view showing a main portion of the receiver-integrated condenser according to the first embodiment.

On the other hand, first, second and third separators 32, 33, 34 are disposed within the second header tank 22. Therefore, an inner space of the second header tank 22 is partitioned into four spaces 22*c*, 22*d*, 22*e*, 22*f* in the up-down direction by the three separators 32–34. FIG. 2 shows a partition structure of the four spaces 22*c*–22*f* in the second header tank 22. In the second header tank 22, the first separator 32 is disposed at a position approximately equal to the height position of the first separator 30 in the first header tank 21, the second separator 33 is disposed at a position approximately equal to the height position of the second separator 31 in the first header tank 21, and the third separator 34 is disposed at a position lower than the second separator 33 by a predetermined distance. Further, the third separator 34 has a protrusion 34*a* protruding into the first refrigerant passage 28. By the protrusion 34*a* of the third separator 34, the first refrigerant passage 28 is partitioned into an upper side portion and a lower side portion.

The first, second and third separators 32–34 having been clad by a brazing material are inserted into the second header tank 22 from slit holes (not shown) of the second header tank 22 to be brazed therein. The inlet joint block 26 communicates with the upper space 21*e* within the first header tank 21 through the communication hole 21*b* shown in FIG. 3, and the outlet joint block 27 communicates with the middle space 21*f* within the first header tank 21 through the communication hole 21*c* shown in FIG. 3.

Figure 7:
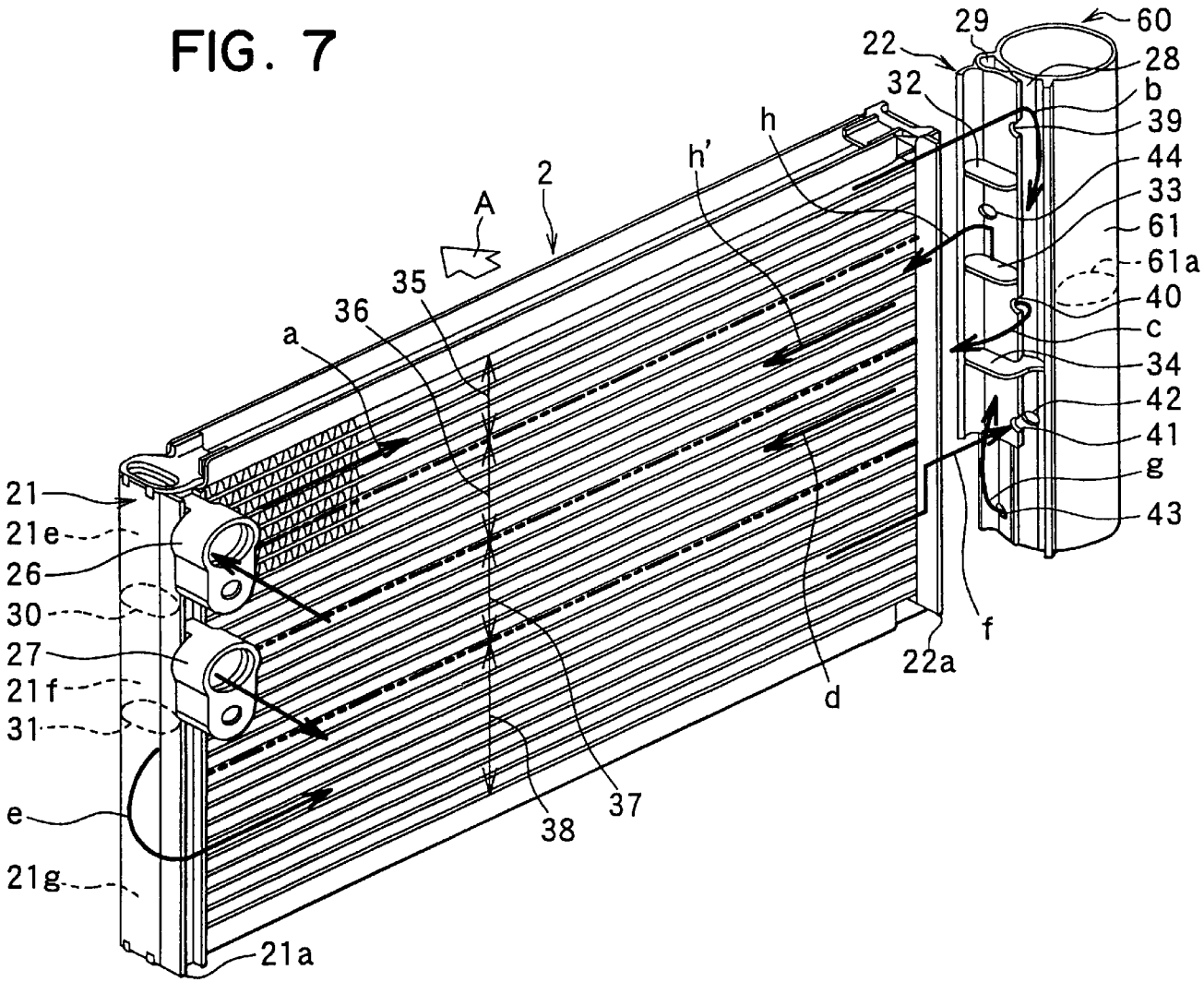
FIG. 7 is an exploded perspective view showing a refrigerant passage structure of the receiver-integrated condenser according to the first embodiment.

Further, as shown in FIGS. 1, 7, the core portion 23 of the receiver-integrated condenser 2 is formed to define a first condensing portion 35, a super-cooling portion 36, a second condensing portion 37 and a third condensing portion 38 which are positioned from an upper side to a lower side in the order. The first condensing portion 35 is formed at an upper side of the first separators 30, 32. Thus, refrigerant from the inlet joint block 26 passes through the first condensing portion 35 as shown by arrow "a" in FIG. 7 through the upper space 21*e* within the first header tank 21. Refrigerant from the first condensing portion 35 passes through the upper space 22*c* within the second header tank 22 as shown by arrow "b" in FIG. 7, and flows into the first refrigerant passage 28 through a communication hole 39 shown in FIG. 4.

In the integrated molding member 60, the communication hole 39 is formed to penetrate through a partition wall for partitioning the upper space 22*c* within the second header tank 22 and the first refrigerant passage 28. Further, in the integrated molding member 60, a communication hole 40 is formed to penetrate through a partition wall for partitioning the space 22*e* within the second header tank 22 and the first refrigerant passage 28. Therefore, refrigerant introduced into the first refrigerant passage 28 flows into the space 22*e* through the communication hole 40 as shown by arrow "c" in FIG. 7. Thereafter, refrigerant passes through the second condensing portion 37 as shown by arrow "d" in FIG. 7, and flows into the lower space 21*g* in the first header tank 21. In the lower space 21*g* of the first header tank 21, refrigerant flows to be U-turned, as shown by arrow "e" in FIG. 7. Thereafter, refrigerant passes through the third condensing portion 38 of the core portion 23 as shown by arrow "f" in FIG. 7, and flows into the lower space 22*f* of the second header tank 22.

Next, refrigerant in the lower space 22*f* of the second header tank 22 flows into the first refrigerant passage 28 through a communication hole 41 shown in FIG. 5, and further flows into the receiving unit 61 through a communication hole 42 shown in FIG. 5. The communication holes 41, 42 are used as a refrigerant inlet of the receiving unit 61. The communication holes 41, 42 are provided at positions greatly lower than a liquid refrigerant surface 61*a* during a normal operation of the refrigerant cycle.

At a position lower than the communication holes 41, 42, a communication hole 43 for communicating a bottom side of the receiving unit 61 and the second refrigerant passage 29 is provided. Therefore, liquid refrigerant within the receiving unit 61 flows into the second refrigerant passage 29 through the communication hole 43 as shown by arrow "g" in FIGS. 5, 7. Liquid refrigerant flows upwardly in the second refrigerant passage 29, and flows into the space 22*d* within the second header tank 22 through a communication hole 44 shown in FIG. 6. The communication hole 44 is provided between the first and second separators 32, 33 in the longitudinal direction of the second header tank 22.

Liquid refrigerant flows from the space 22*d* of the second header tank 22 into the super-cooling portion 36 as shown by arrow "h" in FIG. 7, and passes through the super-cooling portion 36 as shown by arrow "h" in FIG. 7. Thereafter, super-cooled liquid refrigerant flows from the super-cooling portion 36 into the middle space 21*f* of the first header tank 21, and flows to an outside from the outlet joint block 27.

Thus, in the receiver-integrated condenser 2 of the first embodiment, refrigerant flows through the first condensing portion 35, the second condensing portion 37, the third condensing portion 38, the receiving unit 61 and the super-cooling portion 36, in this order. In the first embodiment, components of the receiver-integrated condenser 2 are mode of aluminum, and are integrally assembled by brazing.

Next, operation of the refrigerant cycle according to the first embodiment will be now described. When operation of a vehicle air conditioner is started and the electromagnetic clutch 1*a* is turned on, rotation force of the vehicle engine is transmitted to the compressor 1. Therefore, super-heating gas refrigerant discharged from the compressor 1 flows into the receiver-integrated condenser 2 from the inlet joint block 26. Thereafter, refrigerant passes through the refrigerant passages shown by the arrows "a"–"h" FIG. 7, and super-cooled liquid refrigerant flows into the outlet joint block 27.

Because air (e.g., outside air) is blown by the cooling fan (not shown) toward the core portion 23 of the receiver-integrated condenser 2, gas refrigerant is cooled and condensed to be super-cooled by performing a heat exchange between air and refrigerant. That is, while refrigerant passes through the flat tubes 24 of the first through third condensing portions 35, 37, 38, refrigerant is heat-exchanged with air and is cooled to become a saturated liquid refrigerant including a part gas refrigerant. The saturated liquid refrigerant flows into the receiving unit 61 from the lower space 22*f* of the second header tank 22 through the communication holes 41, 42. Therefore, the saturated liquid refrigerant is separated into gas refrigerant and liquid refrigerant within the receiving unit 61, and liquid refrigerant is stored in the receiving unit 61.

Liquid refrigerant within the receiving unit 61 is introduced into the second refrigerant passage 29 from the communication hole 43, is introduced into the space 22*d* of the second header tank 22 from the second refrigerant passage 29 through the communication hole 44, and thereafter flows through the tubes 24 of the super-cooling portion 36.

In the super-cooling portion 36, liquid refrigerant is cooled again to be in a super-cooled state. Super-cooled liquid refrigerant flows to an outside of the receiver-integrated condenser 2 from the outlet joint block 27 after passing through the middle space 21*f* of the first header tank 21.

Thereafter, super-cooled liquid refrigerant flows into the thermal expansion valve 4 after passing through the sight glass 3. In the expansion valve 4, super-cooled liquid refrigerant is decompressed to become low-temperature low-pressure gas-liquid refrigerant. Thereafter, gas-liquid refrigerant is evaporated in the evaporator 5 by absorbing an evaporation latent-heat from air so that air passing through the evaporator 5 is cooled. Gas refrigerant evaporated in the evaporator 5 is sucked into the compressor 1 to be compressed again.

During an engine idling, because an air flow due to a travelling dynamical force is not generated, a high-temperature air having passed through the receiver-integrated condenser 2 and the radiator may be introduced into again an upstream air side of the receiver-integrated condenser 2 through a lower side portion of the receiver-integrated condenser 2 by the operation of the cooling fan. However, according to the first embodiment, because the super-cooling portion 36 is disposed at an upper side of the second and third condensing portions 37, 38, high-temperature air is not introduced into the arrangement position of the super-cooling portion 36. Thus, even during the engine idling, cooling performance of the super-cooling portion 36 is effectively maintained, and it prevents a super-cooling degree of liquid refrigerant from being reduced.

Because refrigerant in the second and third condensing portions 37, 38 placed at a lower side from the super-cooling portion 36 is in the saturated state, the temperature of refrigerant passing through the second and third condensing portions 37, 38 is higher than that of super-cooled refrigerant of the super-cooling portion 40. Therefore, even when high-temperature air is blown again toward the second and third condensing portions 37, 38, the cooling performance of the receiver-integrated condenser 2 is restricted from being reduced.

Further, according to the first embodiment, the super-cooling portion 36 is disposed between the upper-side first condensing portion 35 and the lower-side second and third condensing portions 37, 38 in the vertical direction. Because air blown from the cooling fan has a high air-flow distribution at a center portion and a low air-flow distribution at side portions in the receiver-integrated condenser 2, the cooling effect of the super-cooling portion 36 is improved due to the middle position arrangement of the super-cooling portion 36.

A second preferred embodiment of the present invention will be now described with reference to FIGS. 8–11. In the above-described first embodiment of the present invention, the sight glass 3 for checking a refrigerant sealing amount within the refrigerant cycle is disposed at a downstream refrigerant side of the outlet joint block 27. Therefore, a gas-liquid state of refrigerant having passed through the super-cooling portion 36 of the receiver-integrated condenser 2 is checked from the sight glass 3. Thus, in the first embodiment, even when refrigerant at an outlet of the receiving unit 61 has a bubble, the bubble disappears in refrigerant flowing through the sight glass 3 due to the cooling effect of the super-cooling portion 36. Therefore, it is difficult to accurately set the refrigerant sealing amount after a bubble disappearance in the sight glass 3, which is a standard of the refrigerant sealing amount when refrigerant is sealed in the refrigerant cycle.

Figure 8:
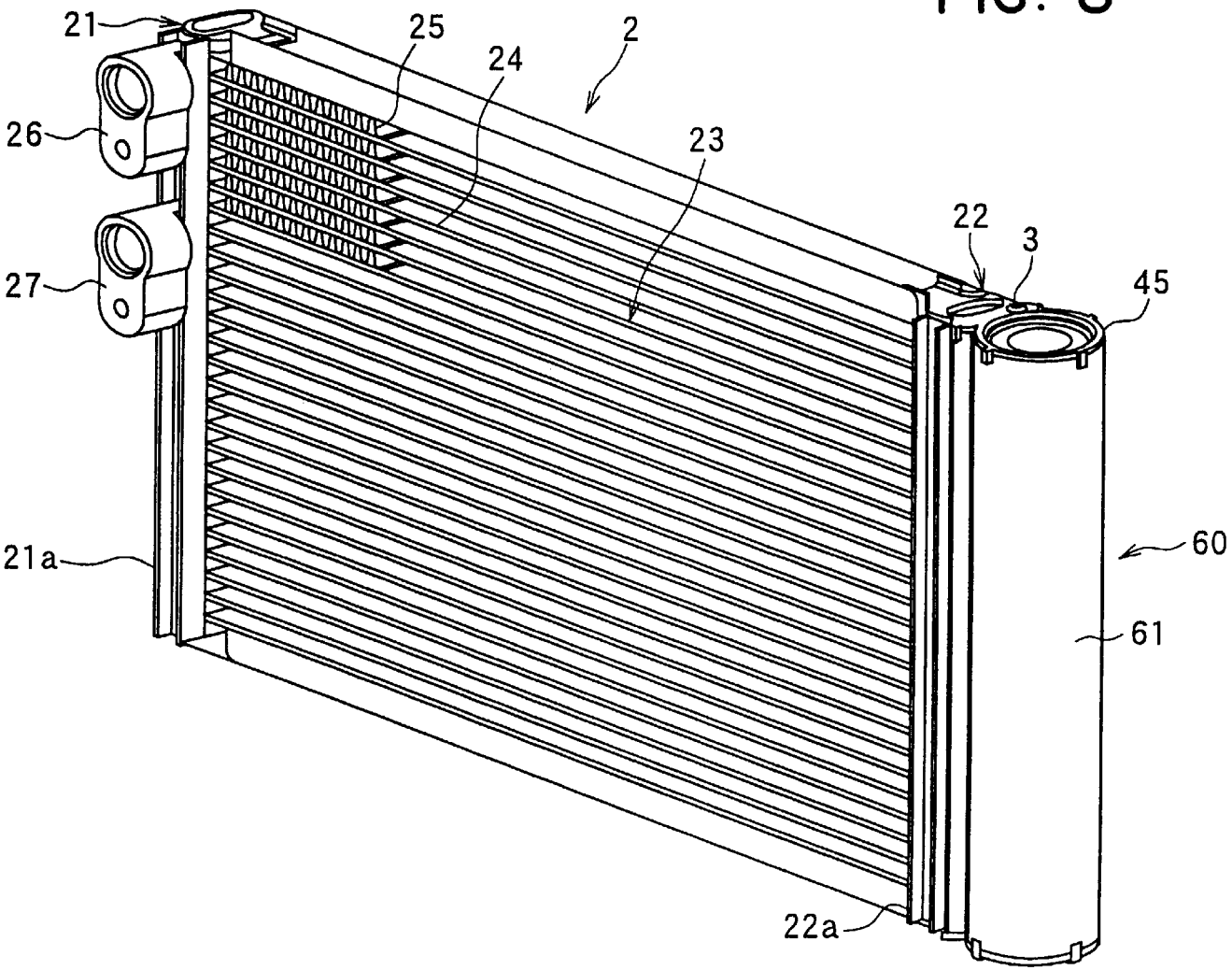
FIG. 8 is a perspective view showing a receiver-integrated condenser according to a second preferred embodiment of the present invention.

Thus, in the second embodiment, the gas-liquid state of the refrigerant at the outlet of the receiving unit 61 is directly checked from a sight glass 3. That is, as shown in FIGS. 8, 9, the sight glass 3 is disposed in a cover member 45 for closing upper end openings of the second header tank 22 and the receiving unit 61 at an upper position of the second refrigerant passage 29 into which liquid refrigerant from the bottom portion of the receiving unit 61 flows.

Figure 9:
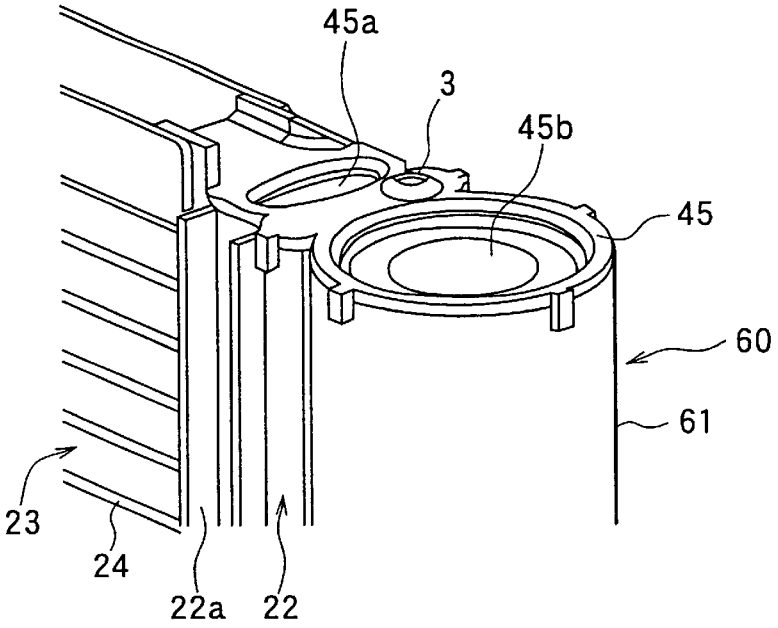
FIG. 9 is an enlarged view showing a main portion of the receiver-integrated condenser according to the second embodiment.
Figure 10:
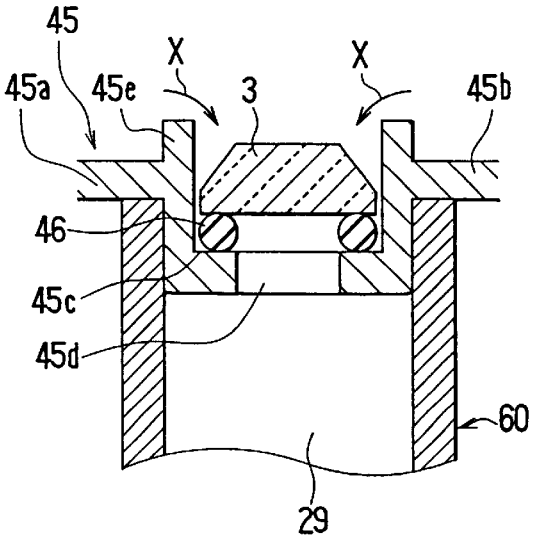
FIG. 10 is a sectional view showing an attachment structure of a sight glass according to the second embodiment.
Figure 11:
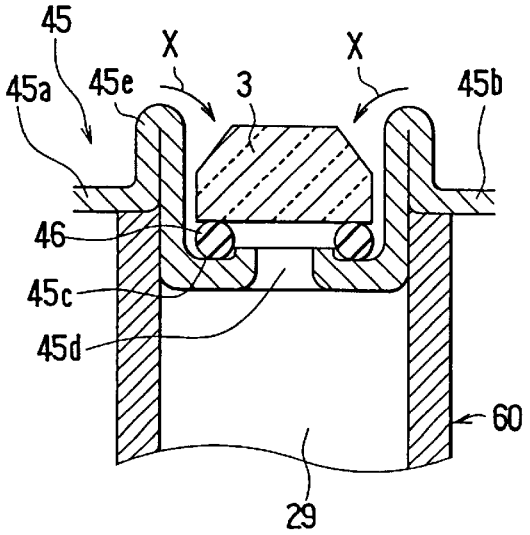
FIG. 11 is a sectional view showing an another attachment structure of the sight glass according to the second embodiment.

As shown in FIGS. 9–11, the cover member 45 includes a first cover portion 45*a* for closing the upper end opening of the second header tank 22, and a second cover portion 45*b* for closing the upper end opening of the receiving unit 61. The first cover portion 45*a* and the second cover portion 45*b* are formed integrally.

In the cover member 45, as shown in FIG. 10, a circular recess portion 45*c* for accommodating the sight glass 3 is formed at the upper position of the second refrigerant passage 29 between the first and second cover portions 45*a*, 45*b*, and a circular hole 45*d* is opened at a center portion of the recess portion 45*c*. Further, a circular fastening protrusion 45*e* is formed at an upper portion of the recess portion 45*c*.

In the second embodiment, the cover member 45 is formed into the shape shown in FIG. 10 by a cold forging or a cutting of an aluminum material. In this state, the receiver-integrated condenser 2 is brazed so that the cover member 45 is bonded to the upper ends of the second header tank 22 and the receiving unit 61 by brazing. After brazing, the sight glass 3 is disposed on the bottom surface of the recess portion 45 through an O-ring 46 for sealing the opening 45*d*. Thereafter, the circular fastening protrusion 45*e* is fastened in an inner side direction as shown by the arrow X in FIG. 10, so that the sight glass 3 is sealed in and fixed into the recess portion 45*c*.

Further, the cover member 45 can be formed into the shape shown in FIG. 11 by pressing of an aluminum material. In FIG. 11, the other portions are similar to those of the cover member 45 in FIG. 10.

According to the second embodiment, it is possible for an operator to directly check the gas-liquid state of refrigerant in the second refrigerant passage 29 (i.e., at the outlet of the receiving unit 61) through the sight glass 3 and the circular hole 45*d*. Therefore, a bubble of refrigerant at the outlet of the receiving unit 61 is accurately detected, and the refrigerant sealing amount in the refrigerant cycle is accurately determined. Further, because the sight glass 3 is disposed in the cover member 45 for closing the upper end openings of the second header tank 22 and the receiving unit 61, the gas-liquid state of refrigerant is readily detected from an upper side of an engine compartment of the vehicle through the sight glass 3.

In the second embodiment, the other components are similar to those in the first embodiment, and the explanation thereof is omitted.

Figure 12:
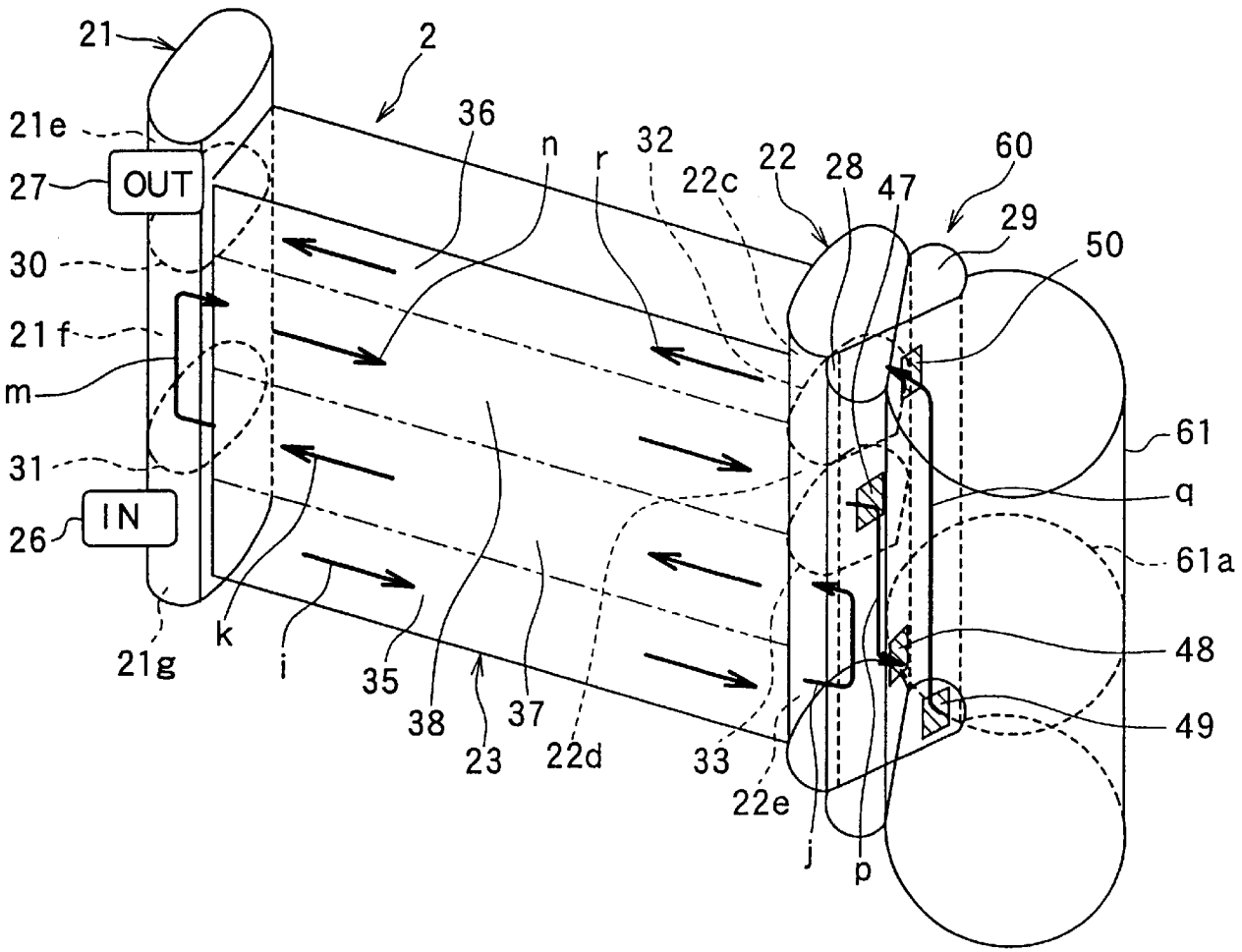
FIG. 12 is a perspective view showing a refrigerant passage structure of a receiver-integrated condenser according to a third preferred embodiment of the present invention.

A third preferred embodiment of the present invention will be now described with reference to FIG. 12. In the above-described first and second embodiments of the present invention, the super-cooling portion 36 is disposed between the first condensing portion 35 at an upper side and the second and third condensing portions 37, 38 at a lower side in the core portion 23. However, in the third embodiment, the super-cooling portion 36 is disposed at a most top portion of the core portion 23.

Thus, in the third embodiment, the inlet joint block 26 is disposed to communicate with the lower space 21*g* among the three spaces 21*e*, 21*f*, 21*g* separated by the first and second separators 30, 31 in the first header tank 21, and the outlet joint block 27 is disposed to communicate with the upper space 21*e* in the first header tank 21.

On the other hand, first and second separators 32, 33 are disposed in the second header tank 22. The first separator 32 is disposed in the second header tank 22 at a height position equal to the first separator 30 within the first header tank 21, and the second separator 33 is disposed in the second header tank 22 at a height position between the first and second separators 30, 31 within the first header tank 21. Thus, an interior space of the second header tank 22 is partitioned into upper, middle and lower three spaces 22*c*, 22*d*, 22*e*.

Next, a refrigerant flow in the receiver-integrated condenser 2 according to the third embodiment will be now described with reference to FIG. 12. Refrigerant from the inlet joint block 26 flows through the first condensing portion 35 positioned at the lowest position of the core portion 23 as shown by arrow "i" in FIG. 12 after passing through the lower space 21*g* within the first header tank 21. Thereafter, refrigerant flowing from the first condensing portion 35 into the lower space 22*e* within the second header tank 22 is U-turned as shown by arrow "j" in FIG. 12. Next, refrigerant passes through the second condensing portion 37 as shown by arrow "k" in FIG. 12, and thereafter, is U-turned in the middle space 21*f* within the first header tank 21 as shown by arrow "m" in FIG. 12.

Next, refrigerant passes through the third condensing portion 38 as shown by arrow "n", and flows into the middle space 22*d* within the second. header tank 22. The middle space 22*d* communicates with the first refrigerant passage 28 through a communication hole 47. Further, the first refrigerant passage 28 communicates with the receiving unit 61 through a communication hole 48 placed at a lower position lower than a refrigerant liquid surface 61*a* within the receiving unit 61 during a normal operation. Thus, refrigerant in the middle space 22*d* flows into the receiving unit 61 after passing through the first refrigerant passage 28 downwardly as shown by arrow "p" in FIG. 12. Further, a communication hole 49 is provided at a position lower than the communication hole 48 so that a bottom area within the receiving unit 61 communicates with the second refrigerant passage 29. Therefore, liquid refrigerant proximate to the bottom of the receiving unit 61 flows into the second refrigerant passage 29 through the communication hole 49, and flows through the second refrigerant passage 29 upwardly as shown by arrow "g" in FIG. 12.

A communication hole 50 is provided at an upper position of the second refrigerant passage 29 so that the second refrigerant passage 29 communicates with the upper space 22*c* within the second header tank 22 through the communication hole 50. Therefore, refrigerant in the second refrigerant passage 29 flows into the upper space 22*c* of the second header tank 22 through the communication hole 50, passes through the super-cooling portion 36 of the core portion 23 as shown by arrow "r" in FIG. 12, and flows into the upper space 21*e* within the first header tank 21. Thereafter, refrigerant in the upper space 21*e* within the first header tank 21 flows to an outside of the receiver-integrated condenser from the outlet joint block 27.

According to the third embodiment, the first condensing portion 35 into which high-temperature refrigerant from the inlet joint block 26 flows is disposed at a lowest position of the core portion 23. Therefore, even when high-temperature air is blown again toward the lower side of the core portion 23, the cooling performance is prevented from decreasing in the receiver-integrated condenser 2. In the thirst embodiment, the other components are similar to those. in the above-described first embodiment, and the explanation thereof is omitted.

Figure 13:
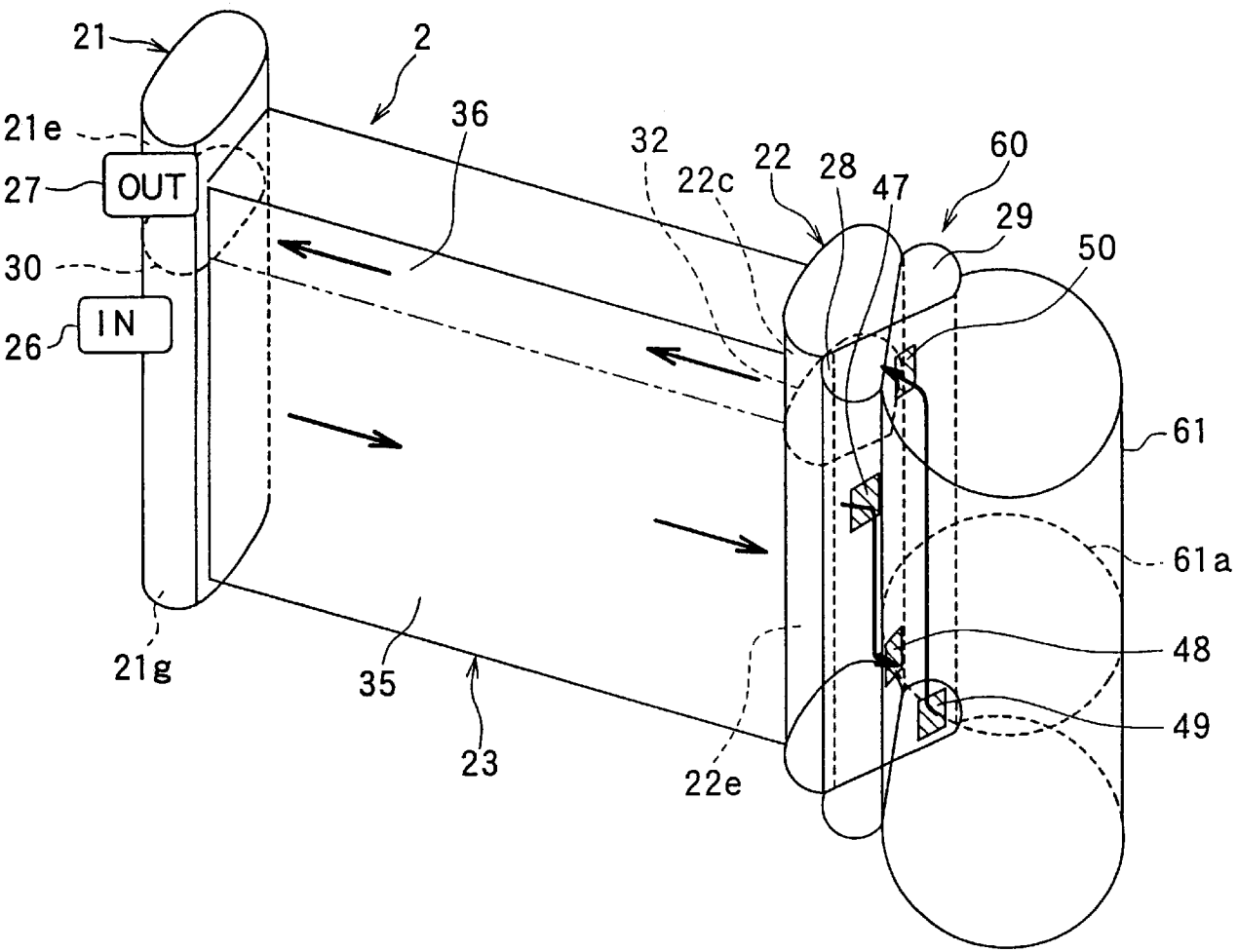
FIG. 13 is a perspective view showing a refrigerant passage structure of a receiver-integrated condenser according to a fourth preferred embodiment of the present invention.

A fourth preferred embodiment of the present invention will be now described with reference to FIG. 13. In the fourth embodiment, the refrigerant passage structure of the third embodiment is made simple. That is, in the fourth embodiment, the super-cooling portion 36 is disposed at the most top side of the core portion 23, while a single condensing portion 35 is disposed at a lower side of the super-cooling portion 36. Therefore, a single separator 30 is disposed within the first header tank 21 so that the interior space of the first header tank 21 is partitioned into upper and lower spaces 21*e,* 21*g,* and a single separator 32 is disposed within the second header tank 22 so that the interior space of the second header tank 22 is partitioned into upper and lower spaces 22*c,* 22*e.*

Figure 14:
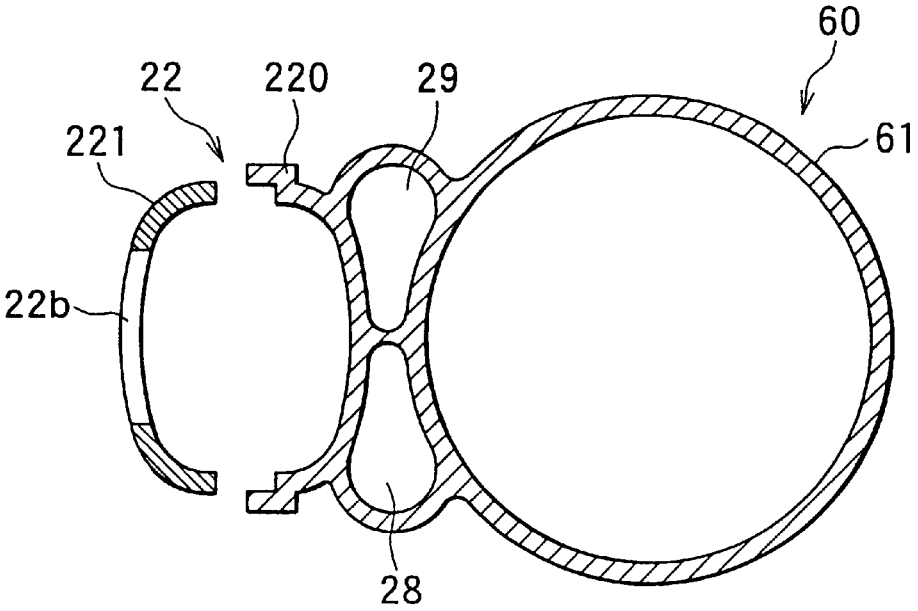
FIG. 14 is an exploded sectional view showing a main portion of a receiver-integrated condenser according to a fifth preferred embodiment of the present invention.

A fifth preferred embodiment of the present invention will be now described with reference to FIG. 14. In each of the above-described first through fourth embodiments, an entire peripheral shape of the second header tank 22 is formed integrally in the integrated molding member 60, and the tube insertion hole 22*b* into which each one side end of the flat tubes 24 is inserted is provided in the integrated molding member 60. However, in the fifth embodiment, as shown in FIG. 14, the cylindrical-shaped second header tank 22 is divided into a first part 220 at the side of the receiving unit 61, and a second part 221 at the side of the core portion 23. The first part 220 of the second header tank 22 has an approximate half cylindrical shape, and is integrally molded in the integrated molding member 60. On the other hand, the second part 221 has an approximately half cylindrical portion 221, and is molded by an aluminum material separately from the integrated molding member 60. The first part 220 of the integrated molding member 60 and the second part 221 are integrally bonded by brazing to form the second header tank 22.

According to the fifth embodiment, because the tube insertion holes 22*b* are provided in the second part 221 of the second header tank 22, a hole opening operation of the tube insertion hole 22*b* becomes simple.

Figure 15:
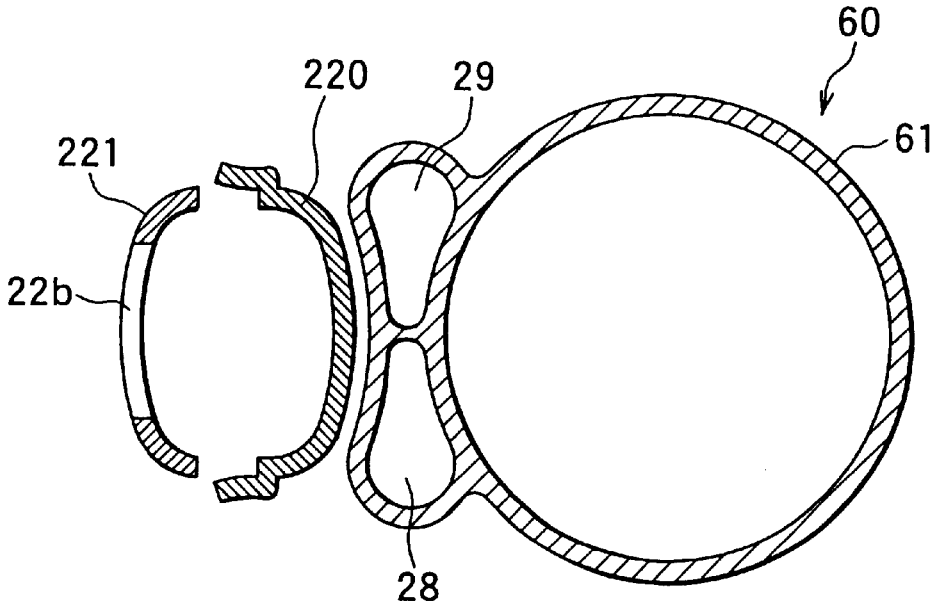
FIG. 15 is an exploded sectional view showing a main portion of a receiver-integrated condenser according to a sixth preferred embodiment of the present invention.

A sixth preferred embodiment of the present invention will be now described with reference to FIG. 15. The sixth embodiment is a modification of the fifth embodiment. In the sixth embodiment, the first part 220 in the second header tank 22 is also molded separately from an integrated molding member 60. Therefore, in the integrated molding member 60, a wall portion for defining the first and second refrigerant passages 28, 29 and the receiving unit 61 are integrally molded.

In the sixth embodiment, the hole opening operation of the tube insertion holes 22*b* becomes simple, and a height of the integrated molding member 60 is readily set to be different from that of the second header tank 22. Therefore, it is possible to readily set the integrated molding portion 60 including the wall portion. defining the first and second refrigerant passages 28, 29 and the receiving unit 61 to be lower than the second header tank 22.

Figure 16:
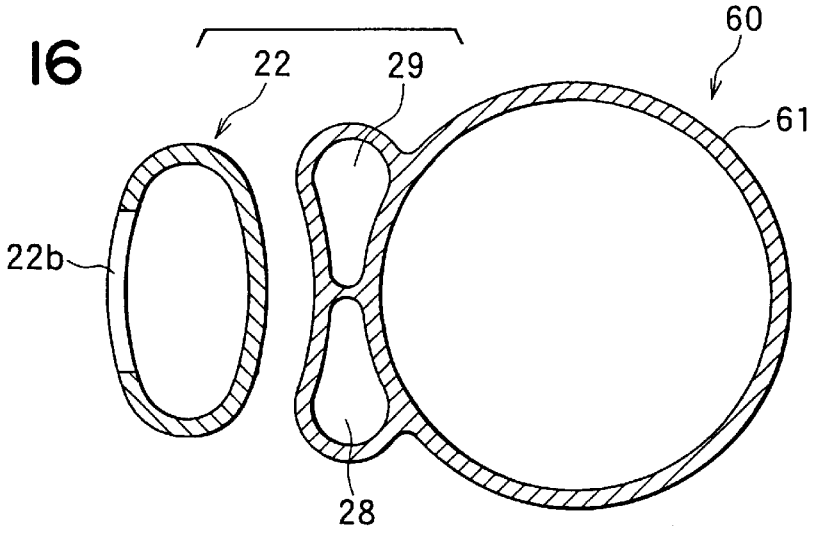
FIG. 16 is an exploded sectional view showing a main portion of a receiver-integrated condenser according to a seventh preferred embodiment of the present invention.

A seventh preferred embodiment of the present invention will be now described with reference to FIG. 16. The seventh embodiment is a modification of the above-described sixth embodiment. In the seventh embodiment, as shown in FIG. 16, the second header tank 22 (i.e., the first and second parts 220, 221) having an approximately cylindrical shape is integrally molded, while being separately molded from an integrated molding member 60. Here, the second header tank 22 may be formed by protrusion or drawing, or may be formed by pipe members. In the seventh embodiment, the integrated molding member 60 includes the wall portion defining the first and second refrigerant passages 28, 29 and the receiving unit 61.

In the seventh embodiment, after both the second header tank 22 and the integrated molding member 60 including the first and second refrigerant passages 28, 29 and the receiving unit 61 are respectively separately molded, and are integrally bonded.

Figure 17:
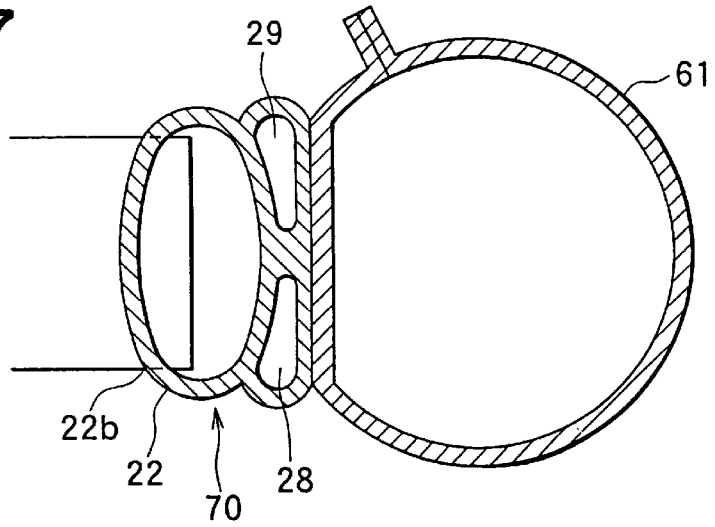
FIG. 17 is an sectional view showing a main portion of a receiver-integrated condenser according to an eighth preferred embodiment of the present invention.

An eighth preferred embodiment of the present invention will be now described with reference to FIG. 17. In the eighth embodiment, as shown in FIG. 17, an integrated molding member 70 including the second header tank 22 and the wall portion defining the first and second refrigerant passages 28, 29 is integrally formed by protrusion, and the receiving unit 61 separately formed from the integrated molding member 70 is bonded to the integrated molding member 70. Here, the receiving unit 61 is formed by bending of an aluminum plate. However, the receiving unit 61 may be formed by drawing of an aluminum material.

Thus, in the eighth embodiment, relative to the second header tank 22 and the first and second refrigerant passages 28, 29, the height of the receiving unit 61 is readily changed.

Figure 18:
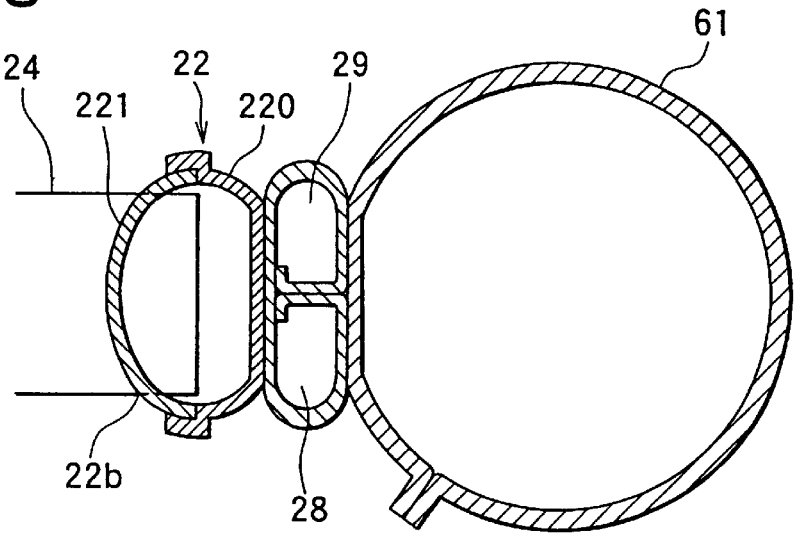
FIG. 18 is a sectional view showing a main portion of a receiver-integrated condenser according to a ninth preferred embodiment of the present invention.

A ninth preferred embodiment of the present invention will be now described with reference to FIGS. 18–20. As shown in FIG. 18, each of the second header tank 22, the wall portion defining the first and second refrigerant passages 28, 29 and the receiving unit 61 is formed by a plate member. Therefore, the second header tank 22, the wall portion defining the first and second refrigerant passages 28, 29 and the receiving unit 61 are respectively separately formed by bending plate members. Generally, bending operation of a plate member is simply performed by pressing. However, in the ninth embodiment, the receiving unit 61 may be formed by drawing of a plate material. After the second header tank 22, the wall portion for defining the first and second refrigerant. passages 28, 29 and the receiving unit 61 are respectively separately formed, those parts are integrally bonded through brazing.

In the ninth embodiment, the second header tank 22 may be integrally formed as shown in FIG. 16. Further, the wall portion for defining the first and second refrigerant passages 28, 29 may be formed independently by protrusion. Similarly, the receiving unit 61 may be formed independently by protrusion.

Figure 19:
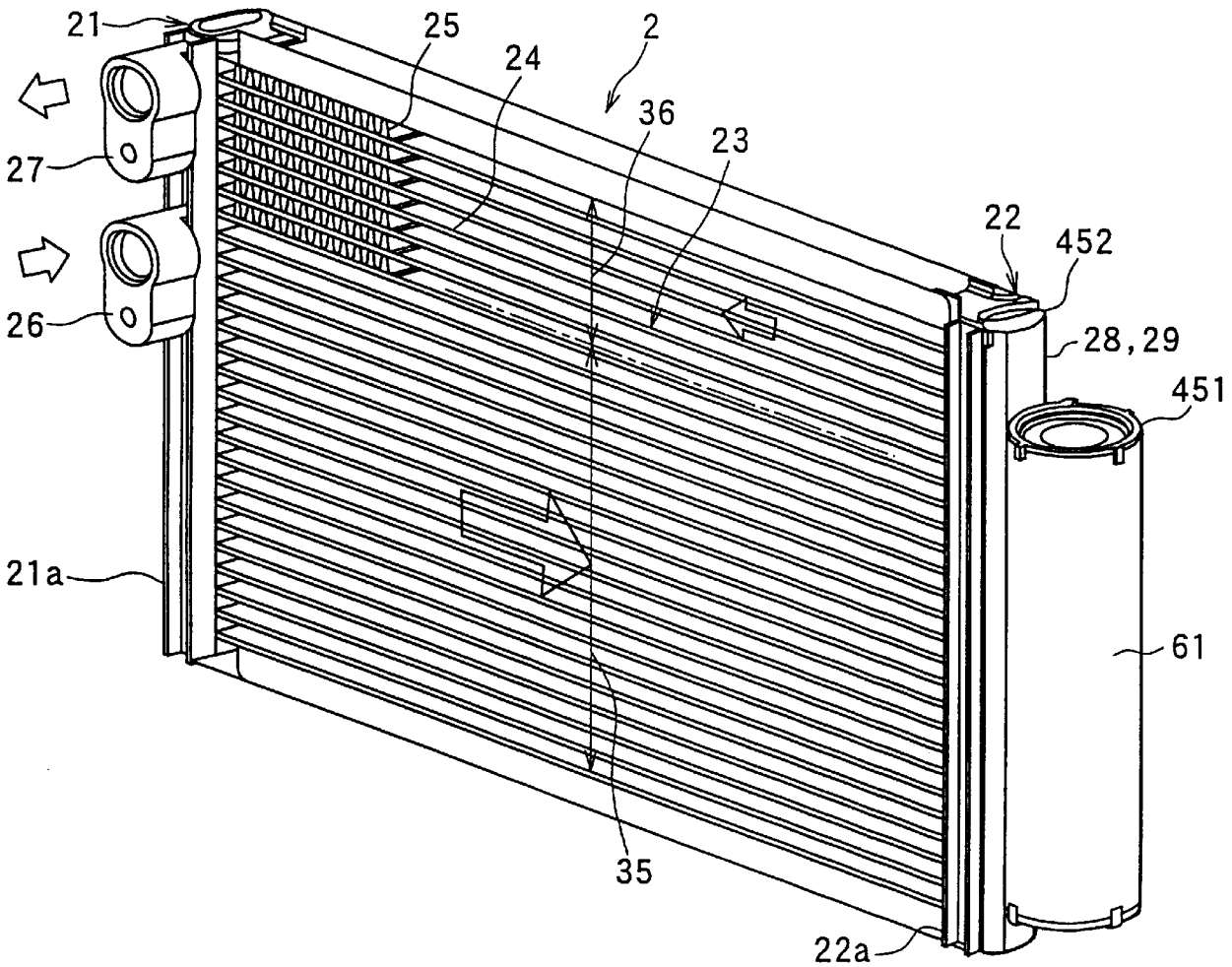
FIG. 19 is a perspective view showing an example of the receiver-integrated condenser according to the ninth embodiment.

FIG. 19 shows an example of a receiver-integrated condenser 2 according to the ninth embodiment. As shown in FIG. 19, in the receiver-integrated condenser 2, the second header tank 22 and the wall portion for defining the first and second refrigerant passages 28, 29 are set to have approximately same height, and the receiving unit 61 is set to be lower than the second header tank 22 and the wall portion defining the first and second refrigerant passages 28, 29. Further, in the ninth embodiment, as shown in FIG. 19, the super-cooling portion 36 is disposed at an upper side of a single condensing portion 35. Therefore, the refrigerant passage structure of the receiver-integrated condenser 2 is similar to that in the fourth embodiment, and the explanation thereof is omitted.

Figure 20:
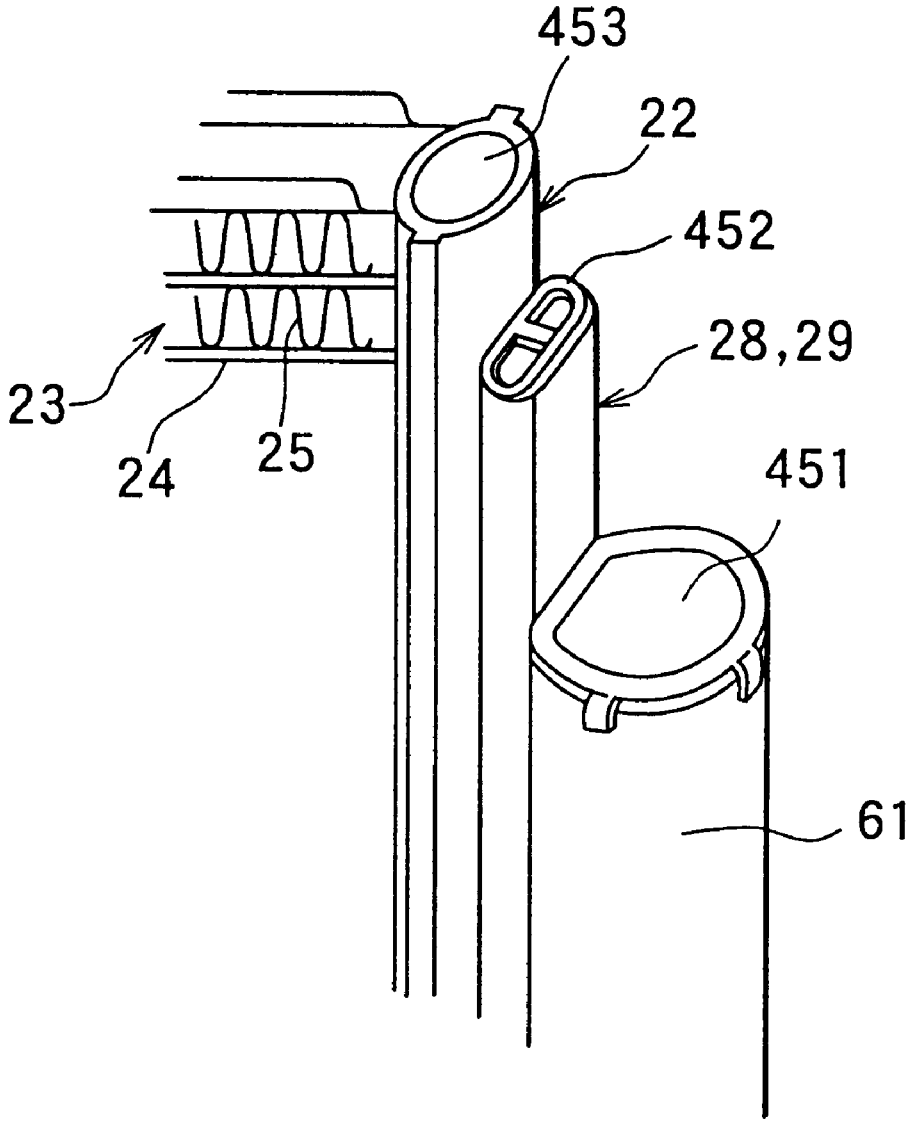
FIG. 20 is a perspective view showing an another example of the receiver-integrated condenser according to the ninth embodiment.

Further, FIG. 20 shows an another. example of a receiver-integrated condenser 2 according to the ninth embodiment. As shown in FIG. 20, the height of the wall portion defining the first and second refrigerant passages 28, 29 is set to be lower than the height of the second header tank 22, and the height of the receiving unit 61 is set to be lower than the height of the wall portion defining the first and second refrigerant passages 28, 29.

According to the ninth embodiment, because the three parts of the second header tank 22, the wall portion defining the first and second refrigerant passages 28, 29 and the receiving unit 61 are respectively independently formed, heights of the three parts are readily set.

As shown in FIG. 20, three cover members 451, 452, 453 for respectively covering the three parts are disposed. In this case, when the sight glass 3 described in the second embodiment is disposed in the cover member 452 of the first and second refrigerant passages 28, 29, the refrigerant sealing amount in the refrigerant cycle is accurately determined from the gas-liquid state of refrigerant at the outlet of the receiving unit 61.

Figure 21:
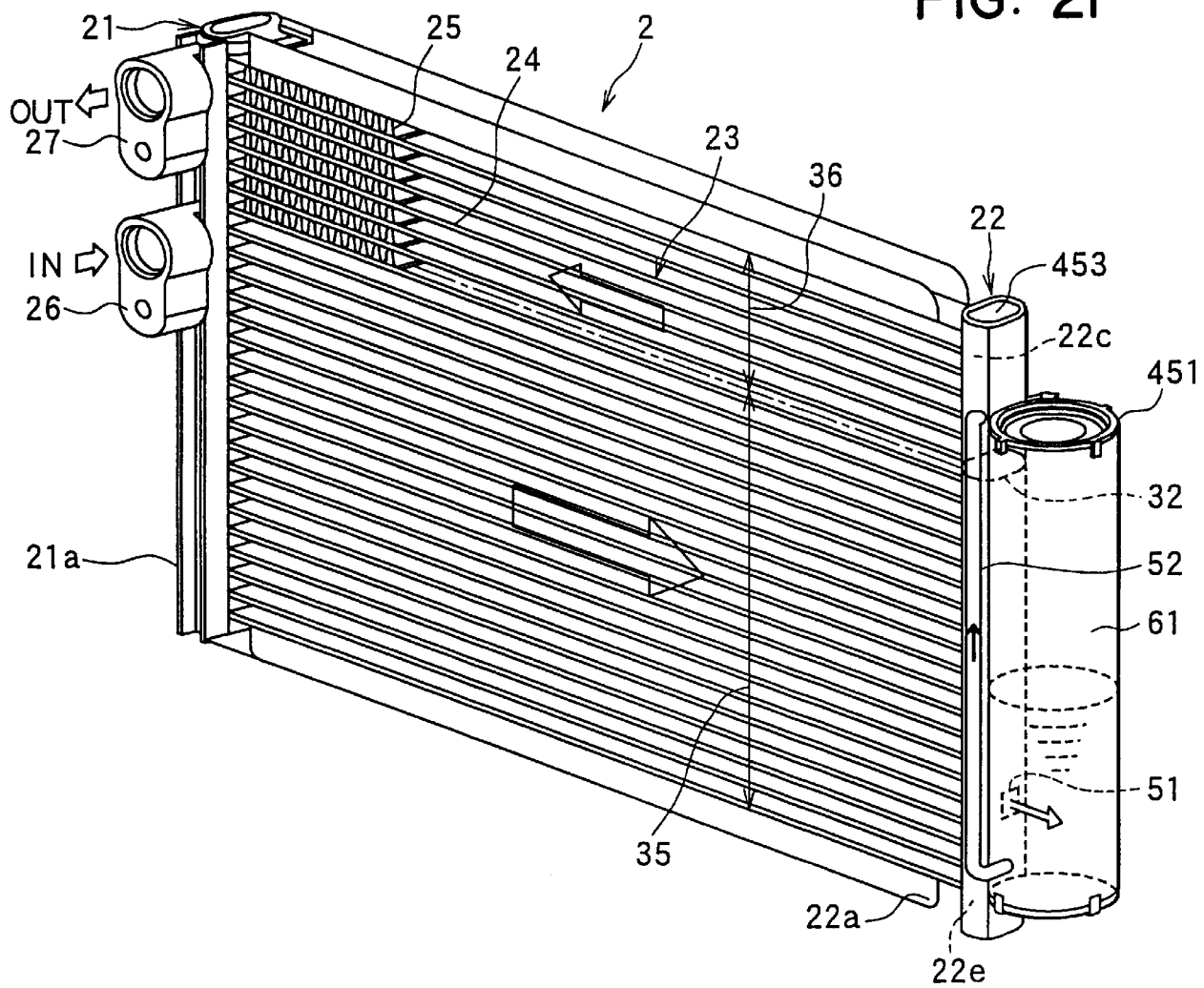
FIG. 21 is a perspective view showing a receiver-integrated condenser according to a tenth preferred embodiment of the present invention.

A tenth preferred embodiment of the present invention will be now described with reference to FIG. 21. In a receiver-integrated condenser 2 of the tenth embodiment, the refrigerant passage structure is similar to that in the above-described fourth embodiment in FIG. 13. As shown in FIG. 21, the receiving unit 61 is directly connected to a side portion of the second header tank 22, and a communication hole 51 for communicating the lower space 22*e* of the second header tank 22 and a lower portion of the receiving unit 61 is formed. Further, a communication pipe 52 extending in the up-down direction is disposed outside the second header tank 22 and the receiving unit 61, so that the bottom side area within the receiving unit 61 communicates with the upper space 22*c* of the second header tank 22 through the communication pipe 52.

Thus, in the tenth embodiment, the communication pipe 52 separately formed from the second header tank 22 and the receiving unit 61 is used as the second refrigerant passage 29 in the fourth embodiment. Further, the communication hole 51 is used as the first refrigerant passage 28 and the communication holes 47, 48 in the fourth embodiment. In the tenth embodiment, by setting the position of the communication hole 51 at a position higher than an inlet port of the communication pipe 52 in the receiving unit 61, gas refrigerant contained in liquid refrigerant from the communication hole 51 is prevented from being introduced into the communication pipe 52.

Figure 22:
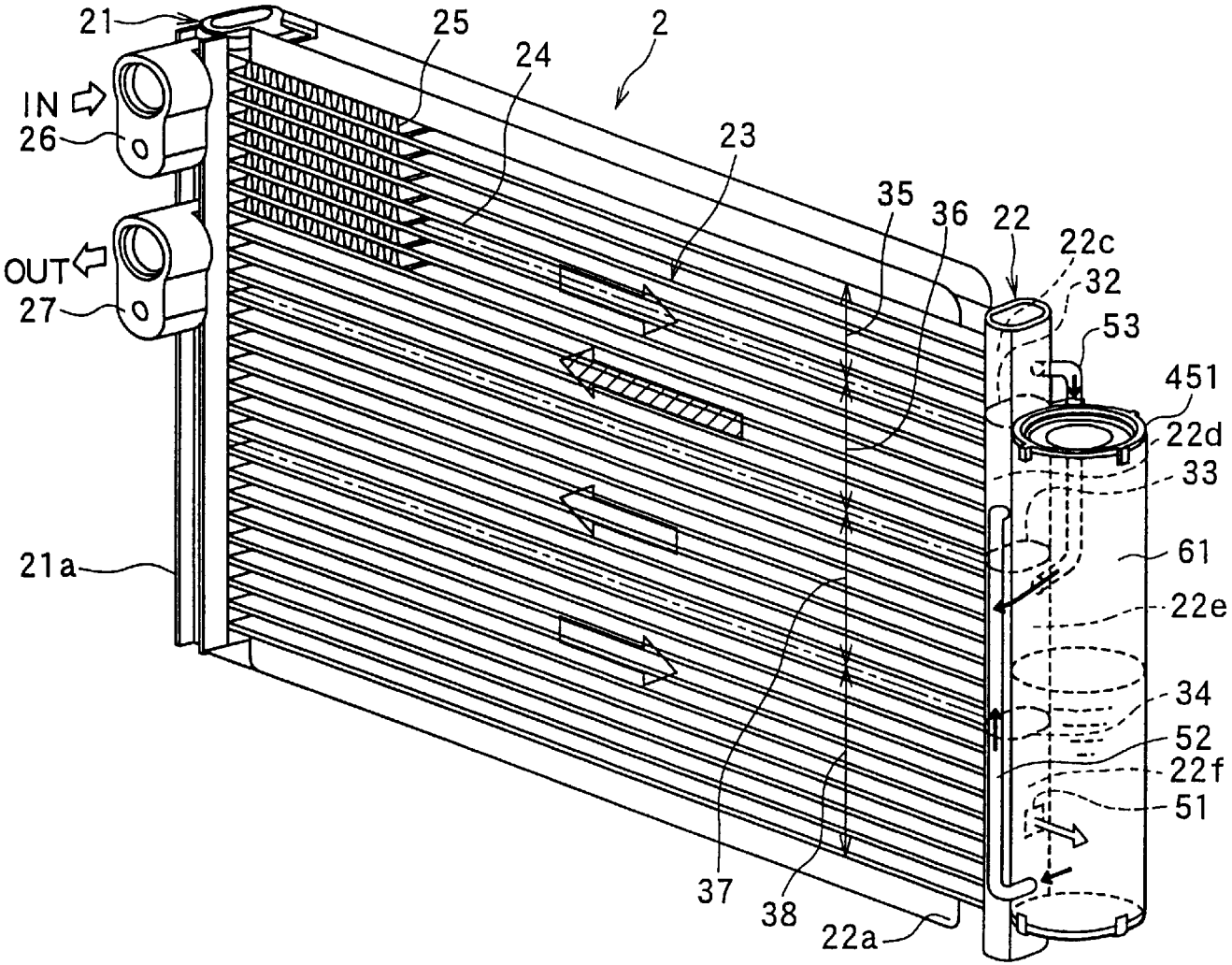
FIG. 22 is a perspective view showing a receiver-integrated condenser according to an eleventh preferred embodiment of the present invention.

An eleventh preferred embodiment of the present invention will be now described with reference to FIG. 22. In a receiver-integrated condenser 2 of the eleventh embodiment, the refrigerant passage structure is similar to that in FIG. 7 of the above-described first embodiment. That is,. the supercooling portion 36 is disposed between the upper side condensing portion 35 and the lower side condensing portions 37, 38 in the core portion. 23. Further, the interior space of the second header tank 22 is partitioned into four spaces 22*c*–22*f* by the first, second and third separators 32, 33, 34.

In the eleventh embodiment, the second header tank 22 and the receiving unit 61 are directly connected, and the communication pipe 52 described in the tenth embodiment and a communication pipe 53 extending in the up-down direction are disposed outside the second header tank 22 and the receiving unit 61. Through the communication pipe 52, the bottom side area within the receiving unit 61 communicates with the space 22*d* within the second header tank 22. On the other hand, through the communication pipe 53, the most top side space 22*c*. within the second header tank 22 communicates with the space 22*d* within the second header tank 22. Further, through the communication hole 51, the bottom side space 22*f* within the second header tank 22 directly communicates with the receiving unit 61.

In the eleventh embodiment, the height of the second header tank 22 is set to be higher than the height of the receiving unit 61. Therefore, it is preferable to independently form the second header tank 22 and the receiving unit 61 using respective plate members. However, the second header tank 22 and the receiving unit 61 may be integrally formed to have the same height.

Figure 23:
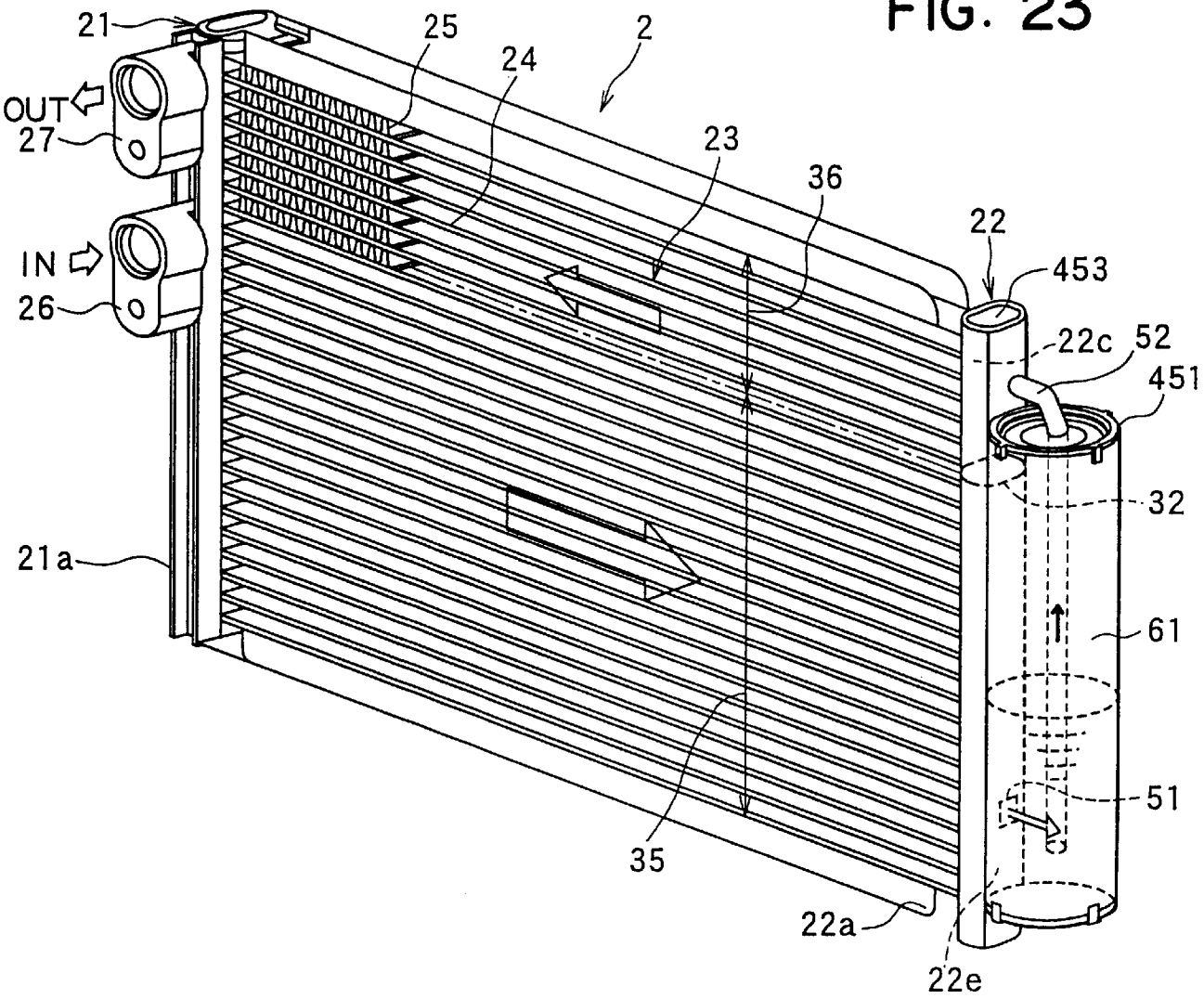
FIG. 23 is a perspective view showing a receiver-integrated condenser according to a twelfth preferred embodiment of the present invention.

A twelfth preferred embodiment of the present invention will be now described with reference to FIG. 23. FIG. 23 shows a receiver-integrated condenser 2 according to the twelfth embodiment of the present invention. In twelfth embodiment, the refrigerant passage structure of the receiver-integrated condenser 2 is similar to that of the above-described tenth embodiment shown in FIG. 21. In the twelfth embodiment, the arrangement position of the communication pipe 52 of the tenth embodiment is changed. That is, in the twelfth embodiment, one side end of the communication pipe 52 penetrating through the cover member 451 is vertically inserted into the receiving unit 61 until a position lower than the communication hole 51. Further, the other side end of the communication pipe 52 communicates with the upper space 22*e* within the second header tank 22. Even in this case, the operation effect similar to that in the tenth embodiment is obtained.

Figure 24:
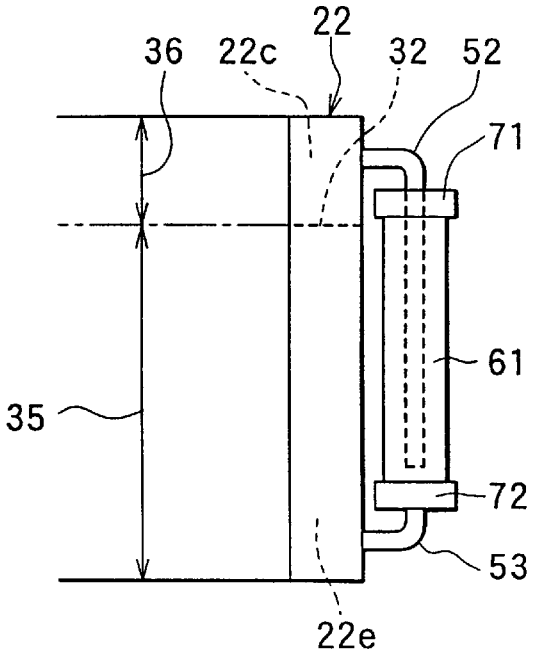
FIG. 24 is a front view showing a main portion of a receiver-integrated condenser according to a thirteenth preferred embodiment of the present invention.

A thirteenth preferred embodiment of the present invention will be now described with reference to FIG. 24. FIG. 24 shows a receiver-integrated condenser of thirteenth embodiment. In the thirteenth embodiment, after a condensing unit including the core portion 23 and the first and second header tanks 21, 22 is assembled, only the receiving unit 61 is assembled to the second header tank 22.

That is, as shown in FIG. 24, firstly, a communication pipe 52 for introducing liquid refrigerant proximate to the bottom of the receiving unit 61 to the upper space 22*c* of the second header tank 22 and a communication pipe 53 for introducing refrigerant within the lower space 22*e* of the second header tank 22 into the receiving unit 61 are integrally brazed with the condensing unit. After the condensing unit is integrally assembled by brazing, block joint portions 71, 72 are disposed at upper and lower end surfaces of the receiving unit 61, and the communication pipes 52, 53 are screwed into the upper and lower end surfaces of the receiving unit 61 through the block joint portions 71, 72. Thus, after the condensing unit is assembled, the receiving unit 61 is integrally connected to the second header tank 22 through the communication pipes 52, 53.

For readily assembling the communication pipe 52 and the receiving unit 61, the communication pipe 52 may be divided into two parts in the block joint portion 71, and the two parts of the communication pipe 52 may be integrally connected in the block joint portion 71.

Figure 25:
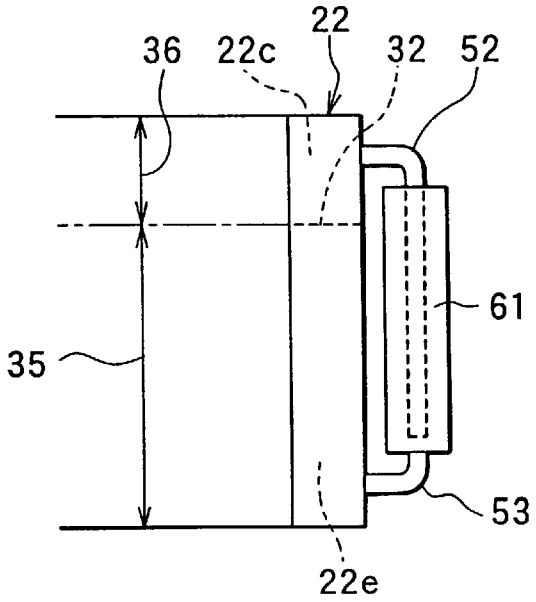
FIG. 25 is a front view showing a main portion of a receiver-integrated condenser according to a fourteenth preferred embodiment of the present invention.

A fourteenth preferred embodiment of the present invention will be now described with reference to FIG. 25. In the fourteenth embodiment, the block joint portions 71, 72 of the thirteenth embodiment are not provided. In the fourteenth embodiment, after the condensing unit described in the thirteenth embodiment is assembled, the communication pipes 52, 53 are assembled to the receiving unit 61, and is bonded to the upper and lower end surfaces of the receiving unit 61 through torch-blazing.

A fifteenth preferred embodiment of the present invention will be now described with reference to FIGS. 26–32. In the above-described first and second embodiments, the second header tank 22, the wall portion defining the first and second refrigerant passages 28, 29 and the receiving unit 61 are integrally molded as the integrated molding member 60. In the fifteenth embodiment, a hole forming method for forming the communication holes 39, 40, 41, 44 in a partition wall 62 for partitioning the second header tank 22 and the first and second refrigerant passages 28, 29, and a hole punching unit are described.

In the fifteenth embodiment, the compartment similar, to those in the above-described first and second embodiments are indicated with the same reference numbers. In the fifteenth embodiment, a hole forming method for forming the communication hole 44 through which the second refrigerant passage 29 and the second header tank 22 communicate with each other, among the communication holes 39, 40, 41, 44, will be described, for example. The receiving unit 61 and the first and second refrigerant passages 28, 29 are partitioned by a partition wall 63.

FIGS. 26–29 shows a main portion of a hole punching unit attached in the integrated molding member 60. Firstly, the hole punching unit is described. The integrated molding member 60 is attached on and is fixed to a work supporting portion 81 provided in a base member 80 of the hole punching unit.

In the base member 80, a jig holding portion 82 is disposed at one end side of the integrated molding member 60 in the longitudinal direction. The jig holding portion 82 is connected to a driving mechanism (not shown). By the driving mechanism, the jig holding portion 82 is moved together with an arm 84 and an arm guide 87 described later in a longitudinal direction (i.e., right-left direction in FIGS. 26–29) of the arm 84.

Figure 27:
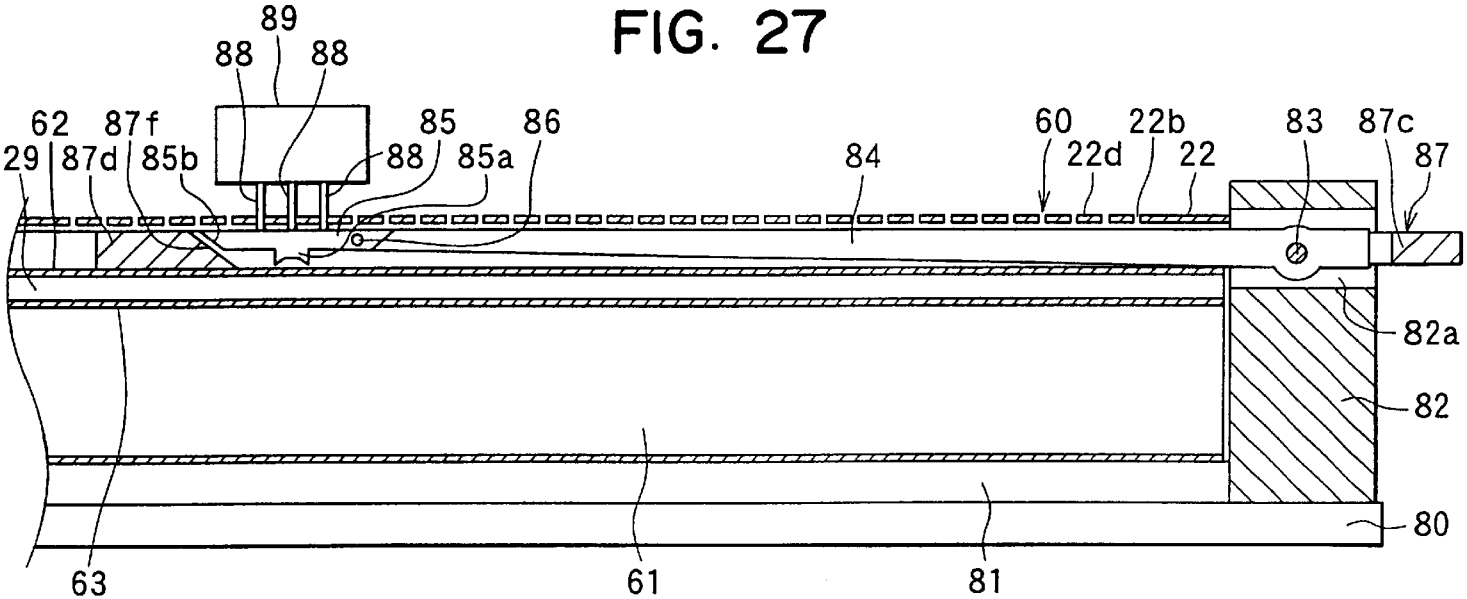
FIG. 27 is a cross-sectional view taken along line XXVII—XXVII in FIG. 26, before punching a hole.

As shown in FIG. 27, an insertion hole 82*a* penetrating through the jig holding portion 82 in the longitudinal direction of the arm 84 is provided in an upper side position of the jig holding portion 82. A pin 83 is fixed in the insertion hole 82*a* in a direction perpendicular to the arm longitudinal direction. One side end (i.e., right side end) of the arm 84 made of metal is rotatable held by the pin 83. That is, the pin 83 is used as a rotation supporting point of the arm 84.

As shown in FIG. 27, the arm 84 is inserted into a space between an outer wall 22*d* having the tube insertion holes 22*b* and the partition wall 62 in the second header tank 22 of the integrated molding member 60. A metal punch 85 is rotatably attached at a top end portion of the arm 84 by a pin 86. At a lower surface portion of the punch 85, a circular blade portion 85*a* is integrally formed to protrude from the lower surface portion of the punch 85.

The arm guide 87 is made of metal, and is disposed to guide the movements of the arm 84 and the punch 85. Therefore, the arm guide 87 prevents an operation error of the arm 84 and the punch 85. Thus, the arm guide 87 includes major dimension portions 87*a*, 87*b* extending in the longitudinal direction of the arm 84 and the punch 85 on both side surfaces of the arm 84 and the punch 85, and minor dimension portion 87*c*, 87*d* connecting between the major dimension portions 87*a*, 87*b*. Therefore, the major dimension portions 87*a*, 87*b* and the minor dimension portions 87*c*, 87*d* of the arm guide 87 are formed into a rectangular frame like.

Figure 26:
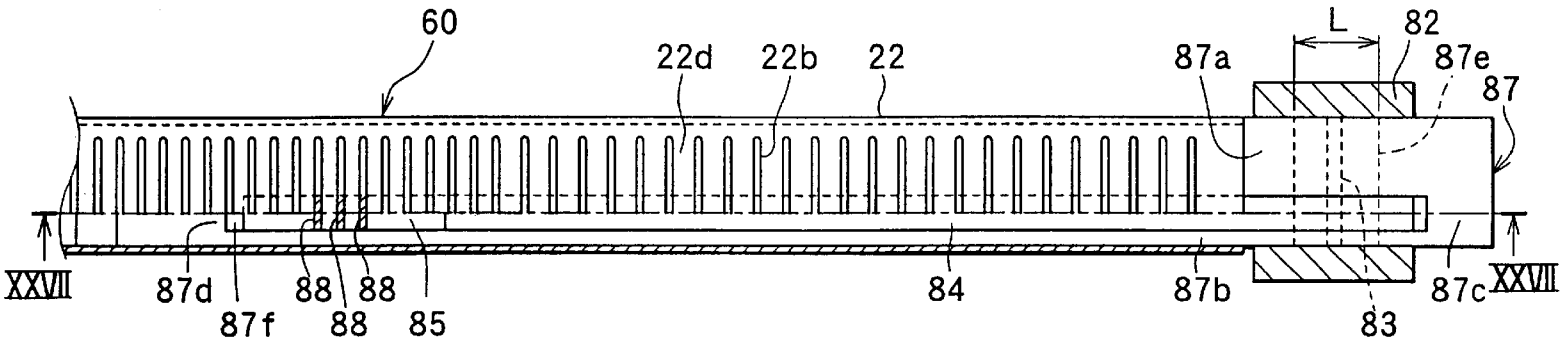
FIG. 26 is a partially sectional plan view showing a hole punching unit according to a fifteenth preferred embodiment of the present invention.

An outer shape dimension of the arm guide 87 is set so that the arm guide 87 is movable in the space between the outer wall of the second header tank 22*d* and the partition wall 62. Further, as shown in FIG. 26, an elongated hole 87*e* having an elongated dimension L is opened in the arm guide 87 so that the pin 83 is floatably inserted in the longitudinal direction of the arm 84. Thus, the arm guide 87 is movable in the arm longitudinal direction relative to the arm 84. Further, the driving mechanism (not shown) is connected to the right side minor dimension portion 87*c* of the arm guide 87, and the arm guide 87 is independently movable in the arm longitudinal direction by the driving force of the driving mechanism.

Further, the arm guide 87 is also used as a cam which returns the position of the punch 85 at the original position before a hole forming operation of the punch 85, after the hole formation due to the punch 85 is finished. Therefore, an inclination cam surface 87*f* inclined relative to the vertical direction by a predetermined angle is formed in the minor dimension portion 87*d* of the arm guide 87 to face the punch 85. On the other hand, an inclination cam surface 85*b* inclined by the predetermined inclination angle along the inclination cam surface 87*f* is also formed at a top end portion of the punch 85.

On the other hand, three pressing jigs (i.e., back-up jig) 88 are inserted into the tube insertion holes 22*b* placed at a direct upper position of the punch 85 to be movable upwardly and downwardly. Each of the pressing jigs 88 is formed into a plate like, and lower ends of the pressing jigs 88 contact an upper surface of the punch 85. Driving force from a driving mechanism 89 is applied to the three pressing jigs 88.

Next, hole forming steps according to the fifteenth embodiment will be now described. Firstly, the integrated molding member 60 is attached to the work supporting portion 81 of the base member 80 to be fixed. Next, the jig holding portion 82 is moved together with the arm 84 and the arm guide 87 in a direction from the right side to the left side in FIGS. 26–29 by the driving mechanism (not shown), so that the arm 84, the punch 85 attached to the arm 84 and the arm guide 87 are inserted into the space between the outer wall 22*d* having the tube insertion holes 22*d* and the partition wall 62.

At this time, the inclination cam surface 87*f* of the left-side minor-dimension portion 87*d* of the arm guide 87 is set to be separated from the inclination cam surface 85*b* of the punch 85 by a predetermined dimension.

Next, the three pressing jigs 88 are pressed downwardly by the driving mechanism 89 so that the punch 85 is pressed downwardly by the pressing jigs 88. Thus, the arm 84 is rotated downwardly by using the pin 83 as the supporting point. Further, because the punch 85 is rotatably connected to the top end portion of the arm 84 to be rotated around the pin 86, the punch 85 moves downwardly while maintaining a horizontal state by the pressing force from the three pressing jigs 88 as shown by arrow A1 in FIG. 28.

Figure 28:
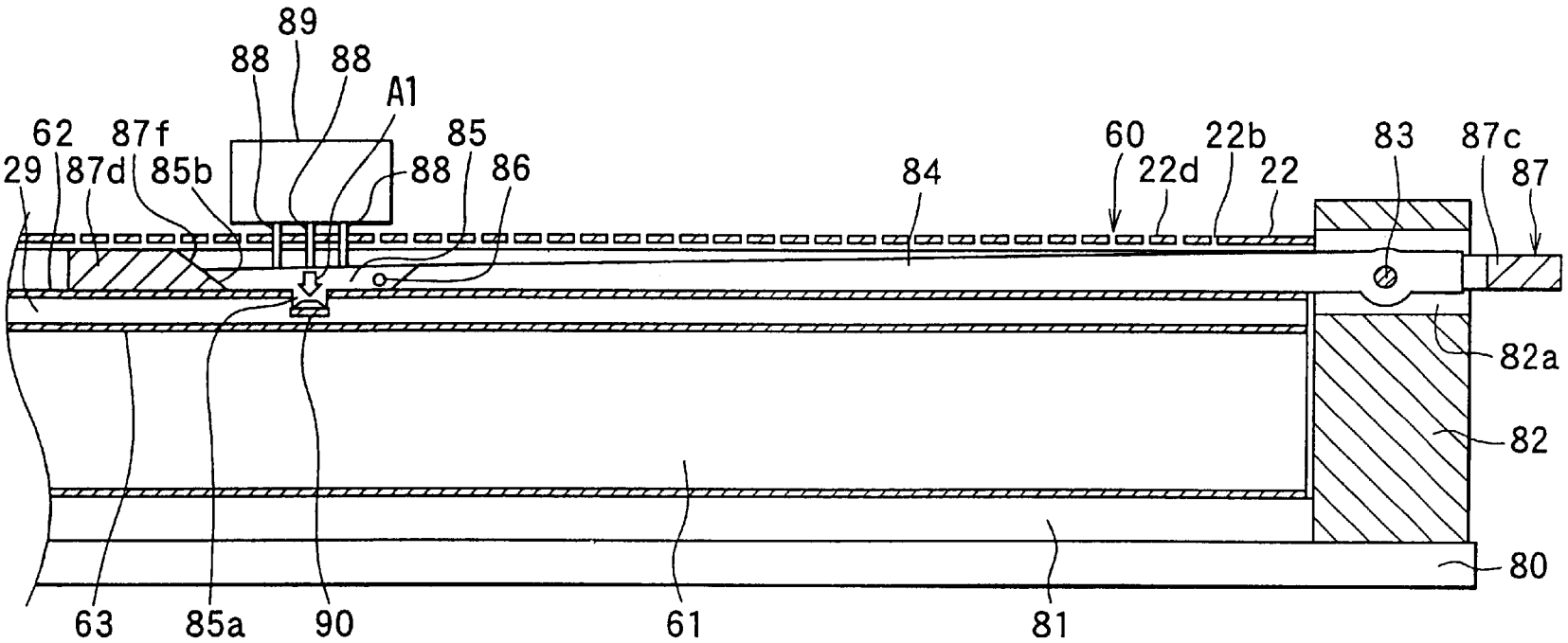
FIG. 28 is a cross-sectional view taken along line XXVII—XXVII in FIG. 26, after punching a hole.
Figure 31B:
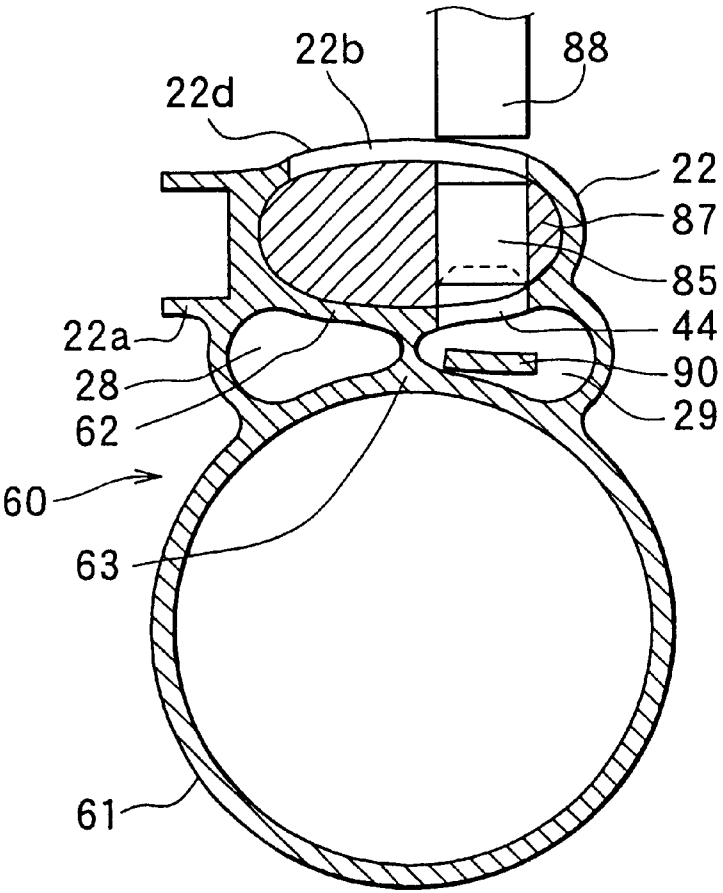
FIGS. 31A and 31B are cross-sectional views taken along line XXXI—XXXI in FIG. 30, respectively showing a position of the hole punching unit after punching the hole, and a position of the hole punching unit after returning the original position.
Figure 31A:
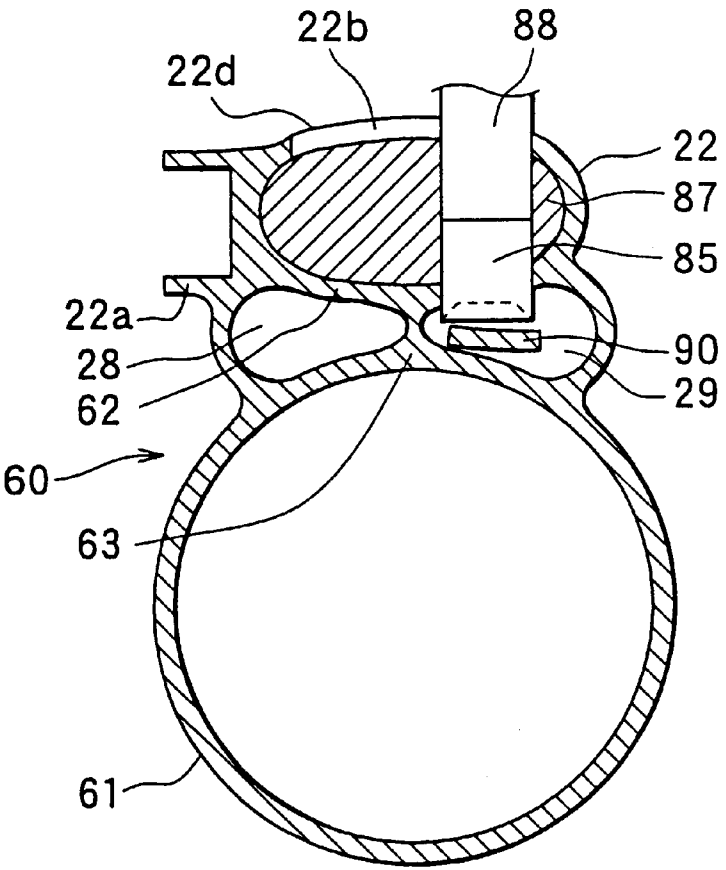

FIGS. 28, 31A show a state after a downward movement of the punch 85 is finished. Pouching load is applied to a predetermined position of the partition wall 62 by the blade portion 85*a* of the punch 85 so that the communication hole 44 is formed by the punching operation at the predetermined position of the partition wall 62. At the state after finishing the hole punching, as shown in FIG. 28, the inclination cam surface 85*b* of the punch 85 contacts a lowest portion of the inclination cam surface 87*f* of the arm guide 87. In FIG. 28, the reference number 90 indicates a punched waste due to the hole punching.

Figure 29:
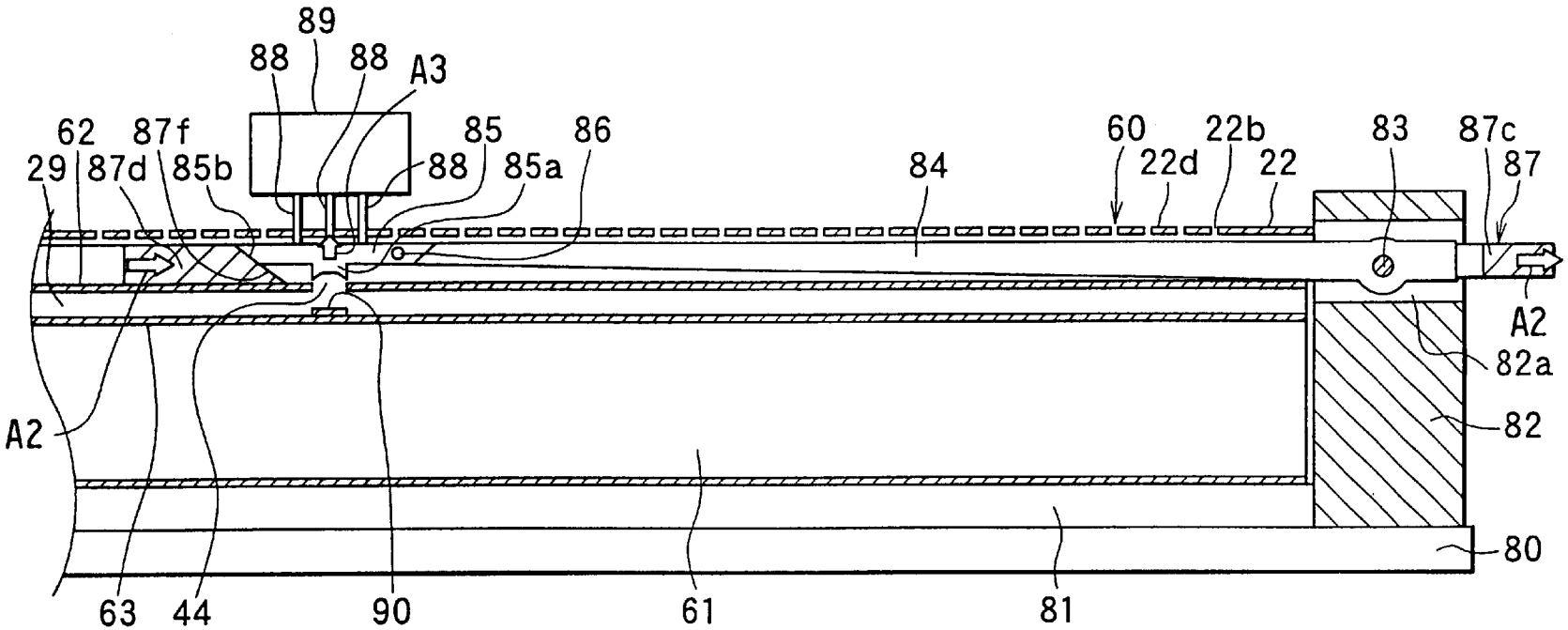
FIG. 29 is a cross-sectional view taken along line XXVII—XXVII in FIG. 26, showing a state after an original state before punching the hole is returned by a cam portion, after the hole is punched.
Figure 30:
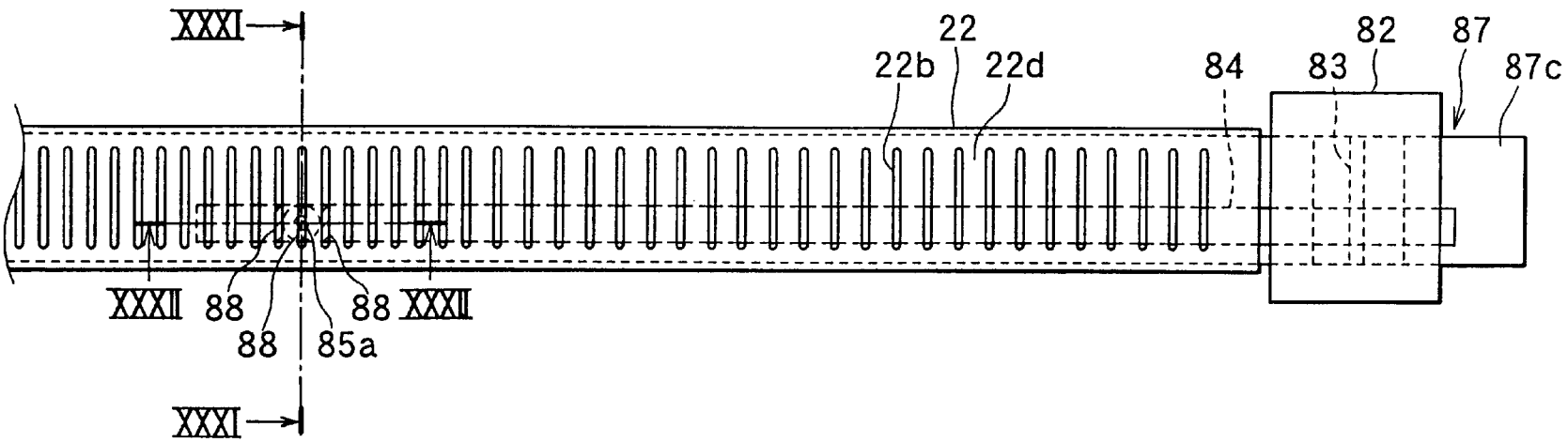
FIG. 30 is a partially plan view showing the hole punching unit and an integrated molding member of a receiver-integrated condenser according to the fifteenth embodiment.

Next, by the driving mechanism (not shown) connected to the right-side minor dimension portion 87*c* of the arm guide 87, the arm guide 87 is independently moved to the right side as shown by arrow A2 in FIG. 29. Therefore, the inclination cam surface 87*f* of the arm guide 87 is inserted into a lower side of the inclination cam surface 85*b* of the punch 85 at the top end portion, and the punch is moved upwardly together with the arm 84 as shown by arrow A3 in FIG. 29. Thus, as shown in FIGS. 29, 31B, the punch 85 returns at the original position before forming the hole.

Next, the arm guide 87 is independently moved in a direction opposite to the arrow A2 from the position in FIG. 29 to the left side to return the original state in FIG. 27. By the above-described steps, one cycle for forming the hole according to the fifteenth embodiment is finished.

In the fifteenth embodiment of the present invention, by using a point where the tube insertion holes 22*b* of the outer wall 22*d* are placed at an immediately upper position of the communication hole 44, the three pressing jigs 88 are inserted into the space between the outer wall 22*d* and the partition wall 62 through the tube insertion holes 22*b,* and pressing force of the pressing jigs 88 is applied to the punch 85 vertically from an immediately upper side of the punch 85. Therefore, the punching press from the punch 85 is sufficiently applied to the partition wall 62, and a hole is accurately opened at a predetermined position of the partition wall 62.

Figure 32:
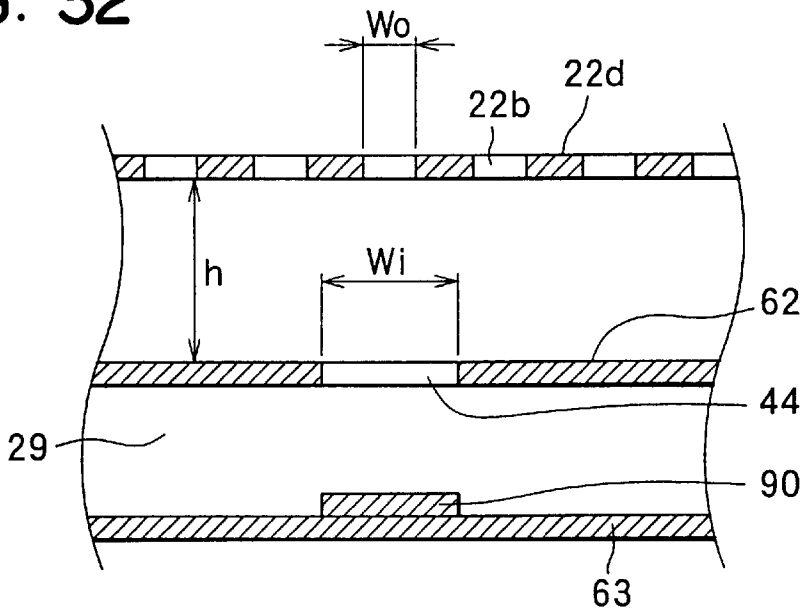
FIG. 32 is a cross-sectional view taken along line XXXII—XXXII in FIG. 30, only showing a part of the receiver-integrated condenser.

Thus, as shown in FIG. 32, even when a height h in the inner space between the outer wall 22*d* and the partition wall 62 is set in a range of 5–15 mm, the communication hole 44 having a width-dimension W1 (e.g., 6 mm) which is greatly larger than each width dimension Wo (e.g., 1–1.5 mm) of the tube insertion holes 22*b* is accurately formed. Here, the partition wall 62 is made of aluminum, and the plate thickness thereof is in a range of 1–1.5. mm. FIG. 32 is a cross-sectional view taken along line XXXII—XXXII in FIG. 30 without showing the hole punching unit.

Further, according to the fifteenth embodiment of the present invention, the punch 85 is connected to the top end portion of the arm 84 to be rotatable. Therefore, it is possible to move the punch 85 downwardly while the punch 85 maintains at the horizontal state, and an error hole in the partition wall 62 is prevented. Further, because the punch 85 is rotatable relative to the arm 84, the arm 84 is prevented from being bent. Further, according to the fifteenth embodiment, the returning operation of punch 85 is accurately performed with a simple structure using the inclination cam surface 87*f* integrally formed with the arm guide 87.

Figure 33:
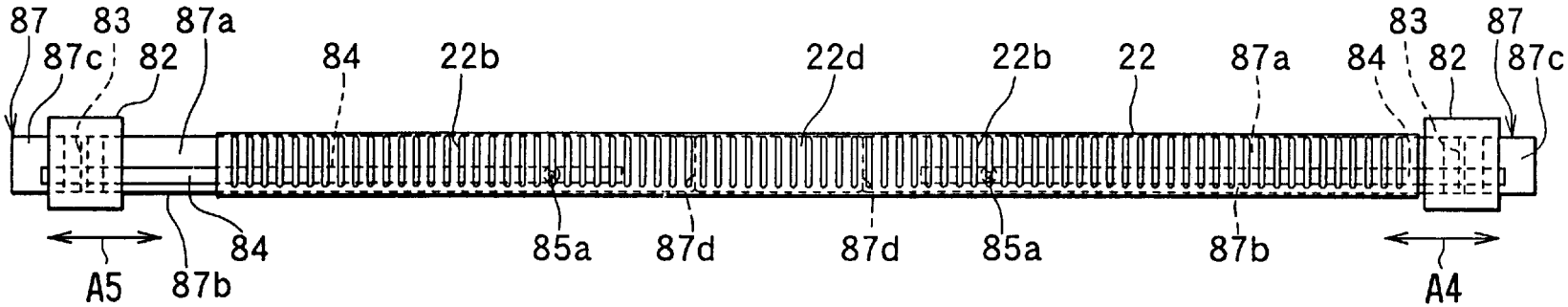
FIG. 33 is a plan view showing a hole punching unit according to a sixteenth embodiment of the present invention.

A sixteenth preferred embodiment of the present invention will be now described with reference to FIG. 33. FIG. 33 is a modification of the above-described fifteenth embodiment. As shown in FIG. 33, both the arm guides 87 and both the arms 84 to each which the punch 85 is attached are respectively inserted into the space between the outer wall 22*d* and the partition wall 62 from both longitudinal end sides of the integrated molding member 60.

According to the sixteenth embodiment, both holes can be simultaneously opened using both the punches 85 of the arms 84 at both longitudinal end sides. Further, because the relative position between the integrated molding member 60 and both the punches 85 is set, both jig holding portions 82 at both longitudinal end sides can be respectively independently controlled by driving mechanisms separately formed. In FIG. 33, Both the jig holding portions 82 are moved respectively independently as shown by arrows A4, A5 in FIG. 33.

In the sixteenth embodiment, the supporting positions (i.e., the positions, of both punches 85) of both the arms 84 are changed by adjusting positions of both the jig holding portions 82. Thus, the positions of the punches 85 relative to the integrated molding member 60 are changed, so that hole positions can be readily changed only by adjusting the positions of the jig holding portions 82. That is, it is unnecessary to change arms 84 having different lengths for changing a hole forming position.

Although the present invention has been fully described in connection with the preferred embodiments thereof with reference to the accompanying drawings, it is to be noted that various changes and modifications will become apparent to those skilled in the art.

For example, in the above-described fifteenth and sixteenth embodiments of the present invention, there are described regarding the hole forming method in the partition wall 62 of the integrated molding member 60 in which the second header tank 22, the wall portion defining the first and second refrigerant passages 28, 29 and the receiving unit 61 are integrated. However, the hole forming method may be used for punching a communication hole in a partition wall between the second header tank 22 and the receiving unit 61 when the second header tank 22 and the receiving unit 61 are directly connected without forming the first and second refrigerant passages 28, 29.

Further, in the above-described fifteenth and sixteenth embodiments, the punch 85 is a lever type where the punch 85 is attached to the arm 84 to be rotatable around the pin 83. However, the arm 84 may be disposed to slide in the up-down direction (i.e., the moving direction of the punch 85).

Further, in the above-described fifteenth and sixteenth embodiments, for changing the hole forming position, the supporting position of the arm 84 to which the punch 85 is attached is set to be changeable. However, for setting the relative position between the integrated molding member 60 and the punch 85, an attachment position of the integrated molding member 60 may be set to be changeable.

Further, in each of the above-described embodiments of the present invention, the inlet joint block 26 and the outlet joint block 27 are separately formed as different compartments. However, in a case where the inlet and outlet joint blocks 26, 27 are disposed adjacently, the inlet and outlet joint blocks 26, 27 may be integrally formed.

Such changes and modifications are to be understood as being within the scope of the present invention as defined by the appended claims.

What is claimed is:

1. A receiver-integrated condenser for a refrigerant cycle, comprising:

a core portion having a plurality of tubes through which refrigerant flows in a horizontal direction, said core portion being disposed to define a condensing member for condensing super-heating gas refrigerant from a compressor of the refrigerant cycle and a super-cooling member for super-cooling liquid refrigerant;

a first header tank extending in a vertical direction perpendicular to the horizontal direction, said first header tank being connected to each one side end of said tubes to communicate with said tubes;

a second header tank extending in the vertical direction, said second header tank being connected to each the other side end of said tubes to communicate with said tubes;

a receiving unit for separating refrigerant from said condensing member into gas refrigerant and liquid refrigerant and for storing liquid refrigerant therein, said receiving unit being integrated with said second header tank; and a wall member for defining a first communication passage through which refrigerant from said condensing member is introduced toward said receiving unit, and a second communication passage through which liquid refrigerant in said receiving unit is introduced toward said super-cooling member, said first and second communication passages being arranged in parallel to extend in the vertical direction along said second header tank and said receiving unit between said second header tank and said receiving unit, wherein at least a part of said condensing member is disposed at a lower side of said super-cooling member, in said core portion.

2. The receiver-integrated condenser according to claim 1, wherein at least two parts of said second header tank, said receiving unit and said wall member for defining said first and second communication passages are an integrally molded member.

3. The receiver-integrated condenser according to claim 1, wherein all of said condensing member is disposed at the lower side of said super-cooling member so that said super-cooling member is positioned at an upper side from said condensing member in said core portion.

4. The receiver-integrated condenser according to claim 1, wherein:

said condensing member includes first and second condensing portions; and said super-cooling member is disposed between said first and second condensing portions in the vertical direction.

5. The receiver-integrated condenser according to claim 1, wherein all said second header tank, said receiving unit and said wall member for defining said first and second communication passages are an integrally molded member.

6. The receiver-integrated condenser according to claim 5, wherein:

said integrally molded member includes an entire peripheral portion of said second header tank formed into an approximately cylindrical shape; and said integrally molded member includes plural tube insertion holes into which the other side ends of said tubes are inserted at a position corresponding to said second header tank.

7. The receiver-integrated condenser according to claim 1, wherein:

said receiving unit and said wall member for defining said first and second communication passages are an integrally molded member, among said second header tank, said receiving unit and said wall member;

said second header tank has a plate member at a side of said core portion;

said plate member is molded to be separated from the integrally molded member; and said plate member has tube insertion holes into which the other side ends of said tubes are inserted.

8. The receiver-integrated condenser according to claim 1, wherein:

said second header tank and said wall member for defining said first and second communication passages are an integrally molded member, among said second header tank, said receiving unit and said wall member; and said receiving unit is bonded to said integrally molded member after being molded separately from said integrally molded member.

9. The receiver-integrated condenser according to claim 1, further comprising:

a cover member for closing at least an upper side opening of said second communication passage; and a sight glass for checking a gas-liquid state of refrigerant in said second refrigerant passage, said sight glass being disposed in said cover member.

10. The receiver-integrated condenser according to claim 1, wherein said second header tank, said receiving unit and said wall member for defining said first and second communication passages are bonded integrally after being molded respectively separately.

11. The receiver-integrated condenser according to claim 10, wherein said second header tank, said receiving unit and said wall member for defining said first and second communication passages are respectively separately formed by different plate members.

12. The receiver-integrated condenser according to claim 10, wherein said second header tank, said receiving unit and said wall member for defining said first and second communication passages have different height dimension in the vertical direction.

13. A receiver-integrated condenser for a refrigerant cycle, comprising:

a condensing member for cooling and condensing super-heating gas refrigerant from a compressor of the refrigerant cycle;

a receiving unit for separating refrigerant from said condensing member into gas refrigerant and liquid refrigerant and for storing liquid refrigerant therein, said receiving unit being integrated with said condensing member; and a super-cooling member for super-cooling liquid refrigerant from said receiving unit, said super-cooling member being integrated with said condensing member, wherein:

said condensing member includes a first condensing portion at an upper side from said super-cooling member, and a second condensing portion at a lower side from said super-cooling portion; and said super-cooling member is disposed between said first and second condensing portions.

14. A receiver-integrated condenser for a refrigerant cycle, comprising:

a core portion having a plurality of tubes through which refrigerant flows in a horizontal direction, said core portion being disposed to define a condensing member for condensing super-heating gas refrigerant from a compressor of the refrigerant cycle and a super-cooling member for super-cooling liquid refrigerant;

a first header tank extending in a vertical direction perpendicular to the horizontal direction, said first header tank being connected to each one side end of said tubes to communicate with said tubes;

a second header tank extending in the vertical direction, said second header tank being connected to each the other side end of said tubes to communicate with said tubes;

a receiving unit for separating refrigerant from said condensing member into gas refrigerant and liquid refrigerant and for storing liquid refrigerant therein, said receiving unit being integrated with said second header tank; and a first communication pipe disposed outside said second header tank and said receiving unit, through which liquid refrigerant in said receiving unit is introduced toward said super-cooling member, wherein all said condensing member is disposed at a lower side of said super-cooling member in the vertical direction, in said core portion.

15. The receiver-integrated condenser according to claim 14, wherein:

said second header tank and said receiving unit are disposed to have a communication hole therebetween through which refrigerant having passed through said second header tank from said condensing member flows toward said receiving unit.

16. A receiver-integrated condenser for a refrigerant cycle, comprising:

a core portion having a plurality of tubes through which refrigerant flows in a horizontal direction, said core portion being disposed to define a condensing member for condensing super-heating gas refrigerant from a compressor of the refrigerant cycle and a super-cooling member for super-cooling liquid refrigerant;

a first header tank extending in a vertical direction perpendicular to the horizontal direction, said first header tank being connected to each one side end of said tubes to communicate with said tubes;

a second header tank extending in the vertical direction, said second header tank being connected to each the other side end of said tubes to communicate with said tubes;

a receiving unit for separating refrigerant from said condensing member into gas refrigerant and liquid refrigerant and for storing liquid refrigerant therein, said receiving unit being integrated with said second header tank;

a first communication pipe disposed outside said second header tank and said receiving unit, through which liquid refrigerant in said receiving unit is introduced toward said super-cooling member; and a second communication pipe disposed outside said second header tank and said receiving unit in such a manner that refrigerant passing through said condensing member flows through a refrigerant passage defined by said second communication pipe;

wherein at least a part of said condensing member is disposed at a lower side of said super-cooling member, in said core portion.

* * * * *